US009321290B1

(12) United States Patent
Tanaka

(10) Patent No.: US 9,321,290 B1
(45) Date of Patent: Apr. 26, 2016

(54) MEDIUM CARTRIDGE AND PRINTER

(71) Applicant: Brother Kogyo Kabushiki Kaisha, Nagoya-shi, Aichi-ken (JP)

(72) Inventor: Mitsugi Tanaka, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/870,098

(22) Filed: Sep. 30, 2015

(30) Foreign Application Priority Data

Oct. 20, 2014 (JP) ..... 2014-213949

(51) Int. Cl.
*B41J 2/01* (2006.01)
*B41J 15/04* (2006.01)
*B41J 3/407* (2006.01)

(52) U.S. Cl.
CPC ..... *B41J 15/044* (2013.01); *B41J 3/4075* (2013.01)

(58) Field of Classification Search
CPC ..... B41J 15/044; B41J 3/4075; B41J 2/01; B41J 29/38; B29C 65/50; B65H 16/00
See application file for complete search history.

(56) References Cited

U.S. PATENT DOCUMENTS 5,708,538 A * 1/1998 Fujino et al. ..... G11B 15/67549 360/95

FOREIGN PATENT DOCUMENTS

| | | | |
|---|---|---|---|
| JP | 2004-067285 | A | 3/2004 |
| JP | 2006-001666 | A | 1/2006 |
| JP | 2007-112600 | A | 5/2007 |
| JP | 3170737 | U | 9/2011 |
| JP | 2014-069328 | A | 4/2014 |

* cited by examiner

*Primary Examiner* — Thinh Nguyen
(74) *Attorney, Agent, or Firm* — Banner & Witcoff, Ltd.

(57) ABSTRACT

The disclosure discloses a medium cartridge including a recording medium roll with a long recording medium wound around an axis, a support member, and at least one of first protruding parts and second protruding parts. The support member rotatably supports the recording medium roll. The first protruding parts are disposed on the recording medium roll so as to respectively protrude to one side and another side in an axial direction and face the support member. The second protruding parts are disposed on the support member so as to respectively protrude to the one side and the another side in the axial direction and face the recording medium roll.

17 Claims, 17 Drawing Sheets

MEDIUM CARTRIDGE AND PRINTER

CROSS-REFERENCE TO RELATED APPLICATION

The present application claims priority from Japanese Patent Application No. 2014-213949, which was filed on Oct. 20, 2014, the disclosure of which is incorporated herein by reference in its entirety.

BACKGROUND

1. Field

The present disclosure relates to a medium cartridge that supplies a long recording medium, and a printer that uses the same.

2. Description of the Related Art

A prior art discloses a medium cartridge that suppliably comprises a recording medium. This medium cartridge (adhesive tape cartridge) comprises a recording medium roll (first roll) around which is wound the long recording medium (print-receiving adhesive tape), and a support member (first bracket part) that rotatably supports the recording medium roll.

In the prior art, the recording medium is sequentially wound in a recording medium roll, from the inside to the outside in a radial direction. Normally, both width-direction end positions (in other words, the width-direction center positions) of the medium are mutually aligned in all layers of the wound recording medium. Nevertheless, depending on the material of the recording medium, displacement from the aligned state may occur as a result of the temperature and humidity conditions during storage, causing the recording medium roll to deform as a result. Further, even in cases where the deformation resulting from temperature and humidity conditions does not occur, displacement and irregular winding of the recording medium similar to that described above may occur due to impact during handling or the like, causing deformation of the recording medium roll similar to the above. In such a case, the handleability and operability of the medium cartridge decrease, resulting in inconvenience.

SUMMARY

It is therefore an object of the present disclosure to provide a medium cartridge and printer capable of improving the handleability and operability of the medium cartridge.

In order to achieve the above-described object, according to an aspect of the present application, there is provided a medium cartridge comprising a recording medium roll with a long recording medium wound around an axis, a support member that rotatably supports the recording medium roll, and at least one of first protruding parts that are disposed on the recording medium roll so as to respectively protrude to one side and another side in an axial direction and face the support member, and second protruding parts that are disposed on the support member so as to respectively protrude to the one side and the another side in the axial direction and face the recording medium roll.

In the present disclosure, the first protruding parts are respectively disposed on one side and another side in the axial direction of the recording medium roll, protruding to the one side and another side and facing the support member. In this case, even if the entire recording medium roll is about to deform on one side (or another side) in the axial direction due to the above reason, the first protruding part contacts the support member, suppressing further deformation.

Or, the second protruding parts disposed on the support member respectively protrude to one side and another side in the axial direction, and face the recording medium roll. In this case, even if the entire recording medium roll is about to deform on one side (or another side) in the axial direction as described above, the second protruding part contacts the recording medium roll that is about to deform, suppressing further deformation.

As a result of the above, according to the present disclosure, it is possible to suppress deformation of the recording medium roll and maintain integrity.

DETAILED DESCRIPTION OF THE PREFERRED EMBODIMENTS

Figure 1:
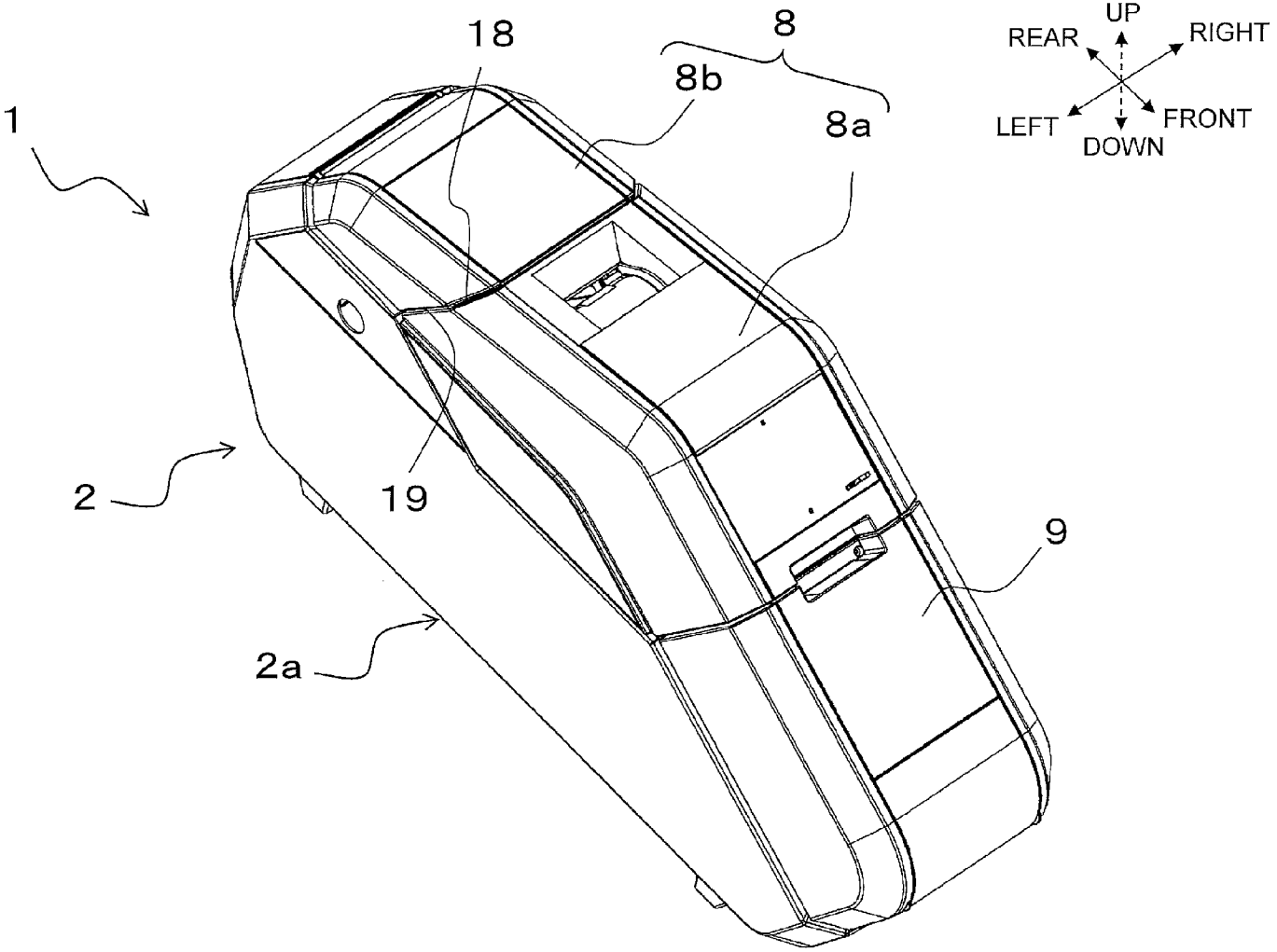
FIG. 1 is a perspective view showing the outer appearance of the tape printer related to an embodiment of the present disclosure.

The following describes an embodiment of the present disclosure with reference to accompanying drawings. Note that, in a case where "Front," "Rear," "Left," "Right," "Up," and "Down" are denoted in the drawings, the terms "Frontward (Front)," "Rearward (Rear)," "Leftward (Left)," "Rightward (Right)," "Upward (Up)," and "Downward (Down)" in the explanations of the description refer to the denoted directions.

General Configuration of Tape Printer

First, the general configuration of the tape printer related to this embodiment will be described with reference to FIGS. 1-4.

Housing

In FIGS. 1-4, a tape printer 1 in this embodiment comprises a housing 2 that constitutes the apparatus outer contour. The housing 2 comprises a housing main body 2*a*, a rearward-side opening/closing part 8, and a frontward-side opening/closing cover 9.

The housing main body 2*a* comprises a first storage part 3 disposed on the rearward side, and a second storage part 5 and a third storage part 4 disposed on the frontward side.

The rearward-side opening/closing part 8 is connected to an upper area of the rearward side of the housing main body 2*a* in an openable and closeable manner. This rearward-side opening/closing part 8 is capable of opening and closing the area above the first storage part 3 by pivoting. The rearward-side opening/closing part 8 includes a first opening/closing cover 8*a* and a second opening/closing cover 8*b*.

The first opening/closing cover 8*a* is capable of opening and closing the area above the frontward side of the first storage part 3 by pivoting around a predetermined pivot axis K1 disposed in the upper area of the rearward side of the housing main body 2*a*. Specifically, the first opening/closing cover 8*a* is capable of pivoting from a closed position (the states in FIGS. 1 and 2) in which it covers the area above the frontward side of the first storage part 3, to an open position (the states in FIGS. 3 and 4) in which it exposes that area.

Figure 2:
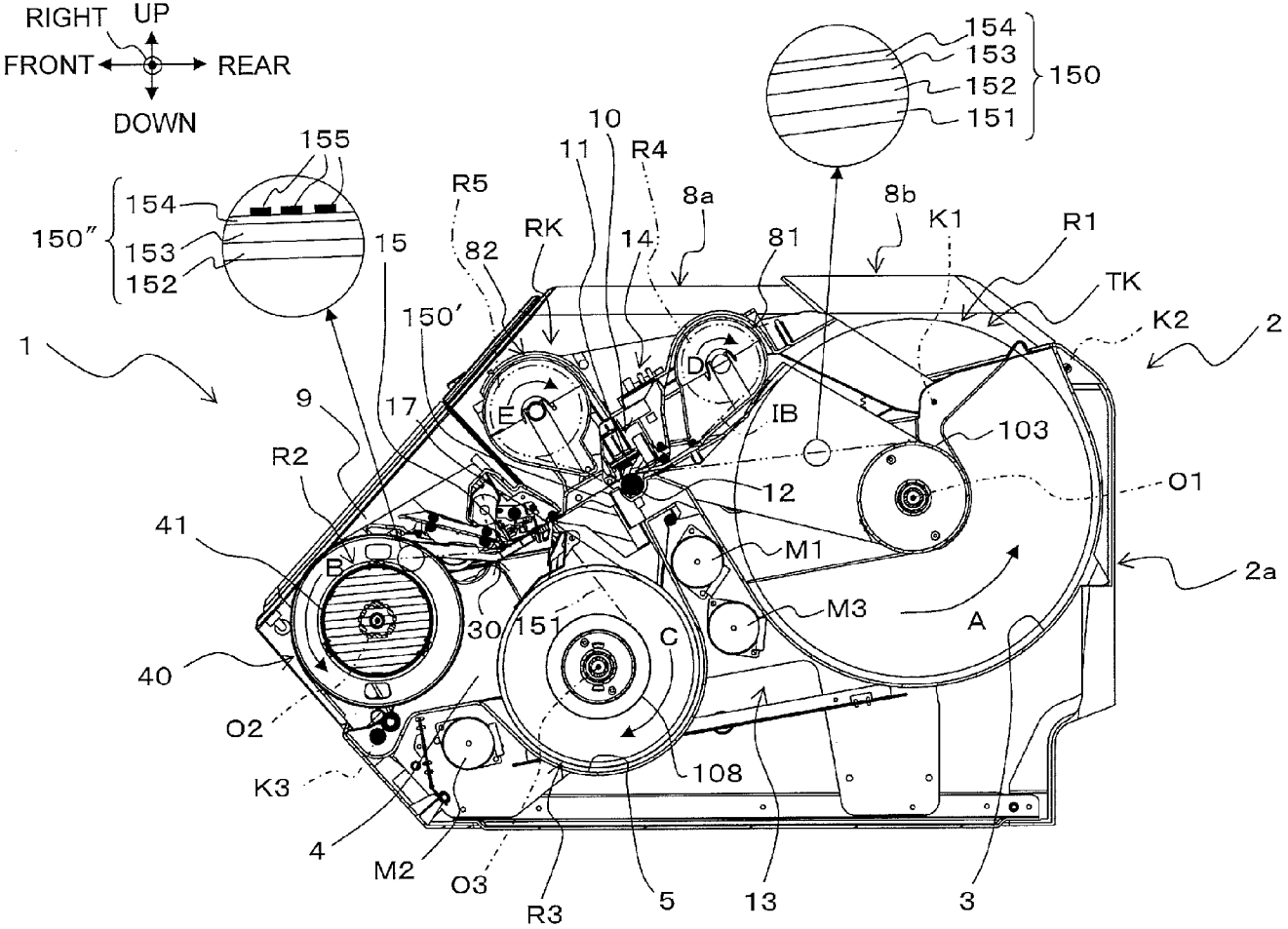
FIG. 2 is a side cross-sectional view showing the internal structure of the tape printer.
Figure 3:
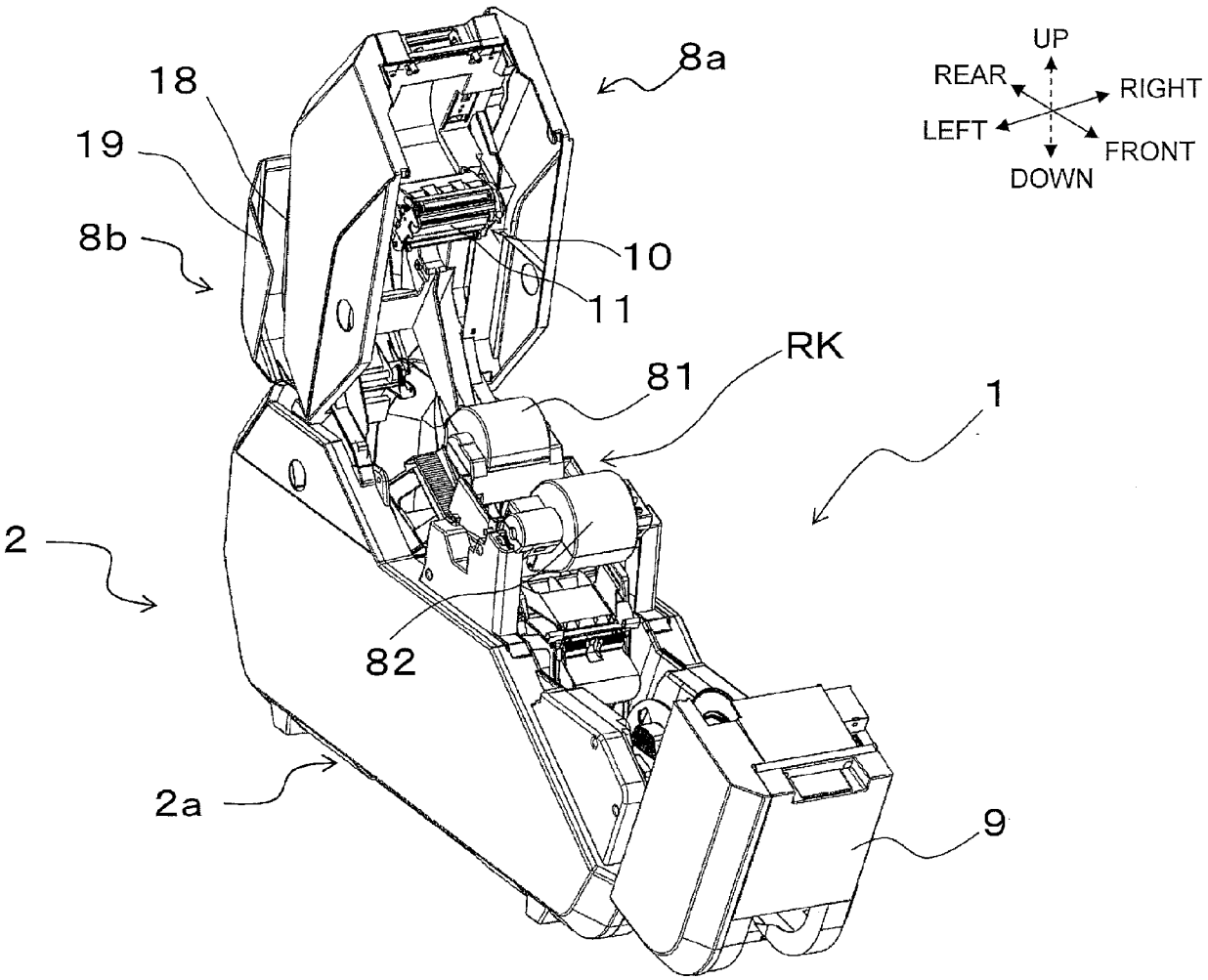
FIG. 3 is a perspective view showing the outer appearance of the tape printer with the first, second, and frontward-side opening/closing covers open.

A head holding body 10 is disposed in the interior of the first opening/closing cover 8*a* (refer to FIG. 3 as well). Then, the first opening/closing cover 8*a* pivots around the above described pivot axis K1, making it possible to move a printing head 11 disposed in the head holding body 10 relatively closer to or farther away from a feeding roller 12 disposed in the housing main body 2*a*. Specifically, the first opening/closing cover 8*a* is capable of pivoting from a closed position (the states in FIGS. 1 and 2) in which the printing head 11 is close to the feeding roller 12, to an open position (the states in FIGS. 3 and 4) in which the printing head 11 is far away from the feeding roller 12.

The second opening/closing cover 8*b* is disposed further to the rearward side than the above described first opening/closing cover 8*a*, and is capable of opening and closing the area above the rearward side of the first storage part 3 separately from the opening and closing of the above described first opening/closing cover 8*a* by pivoting around a predetermined pivot axis K2 disposed on the upper end of the rearward side of the housing main body 2*a*. Specifically, the second opening/closing cover 8*b* is capable of pivoting from a closed position (the states in FIGS. 1 and 2) in which it covers the area above the rearward side of the first storage part 3, to an open position (the states in FIGS. 3 and 4) in which it exposes that area.

Then, the first opening/closing cover 8*a* and the second opening/closing cover 8*b* are configured so that, when each is closed, an outer peripheral part 18 of the first opening/closing cover 8*a* and an edge part 19 of the second opening/closing cover 8*b* substantially contact each other and cover almost the entire area above the first storage part 3.

The frontward-side opening/closing cover 9 is connected to the upper area of the frontward side of the housing main body 2*a* in an openable and closeable manner. The frontward-side opening/closing cover 9 is capable of opening and closing the area above the third storage part 4 by pivoting around a predetermined pivot axis K3 disposed on the upper end of the frontward side of the housing main body 2*a*. Specifically, the frontward-side opening/closing cover 9 is capable of pivoting from a closed position (the states in FIGS. 1 and 2) in which it covers the area above the third storage part 4, to an open position (the states in FIGS. 3 and 4) in which it exposes that area.

Print-Receiving Tape Roll and Surrounding Area Thereof

Figure 4:
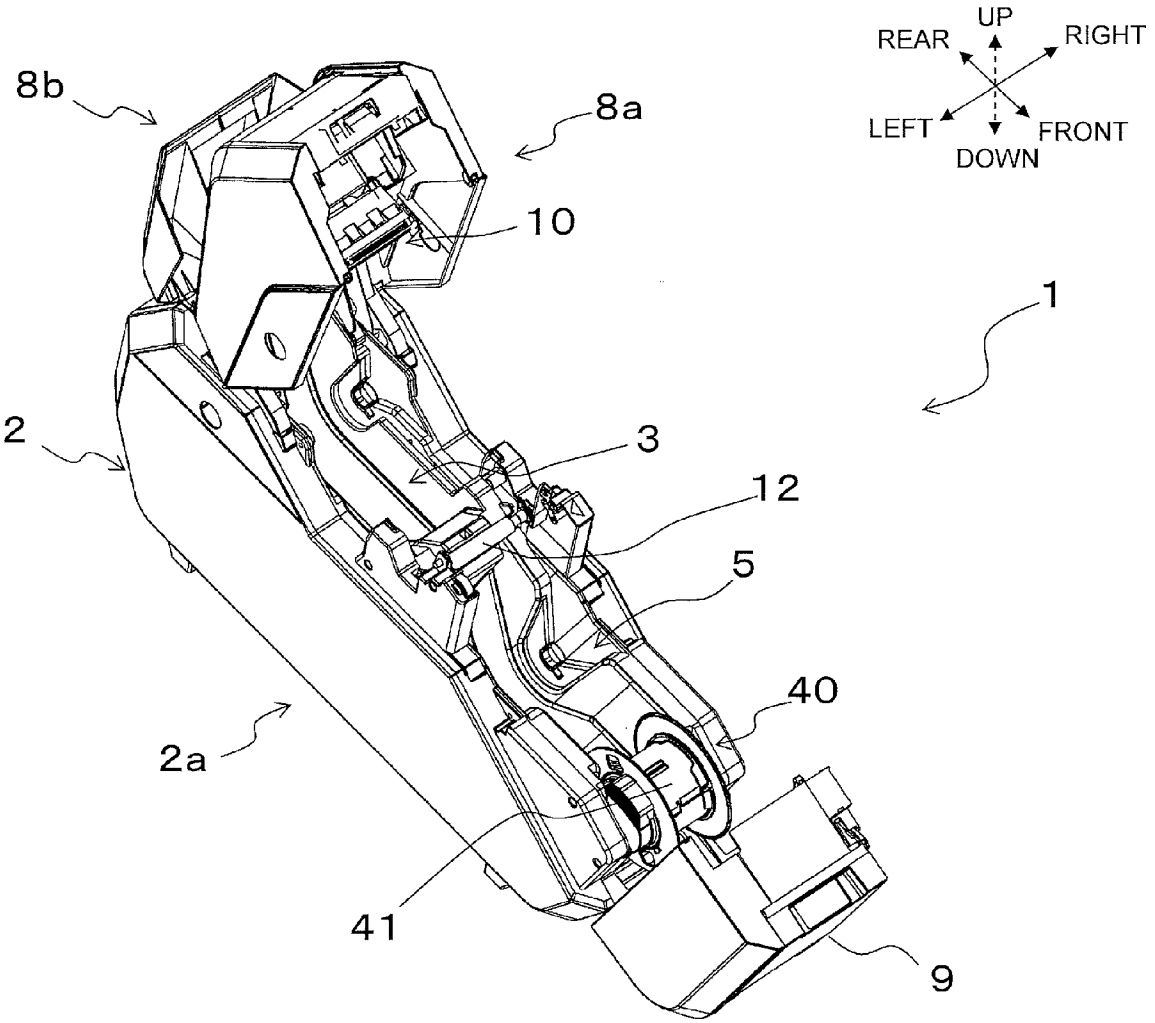
FIG. 4 is a perspective view showing the tape printer with the first, second, and frontward-side opening/closing covers open and the tape cartridge and ink ribbon cartridge removed.

At this time, as shown in FIGS. 2-4, a tape cartridge TK (refer to FIG. 2) is detachably mounted in a first predetermined position 13 below the frontward-side opening/closing cover 9 (when closed) of the housing main body 2*a*. This tape cartridge TK comprises a print-receiving tape roll R1 formed around a winding core 103 (refer to FIG. 8 described later as well) comprising an axis O1.

Figure 5:
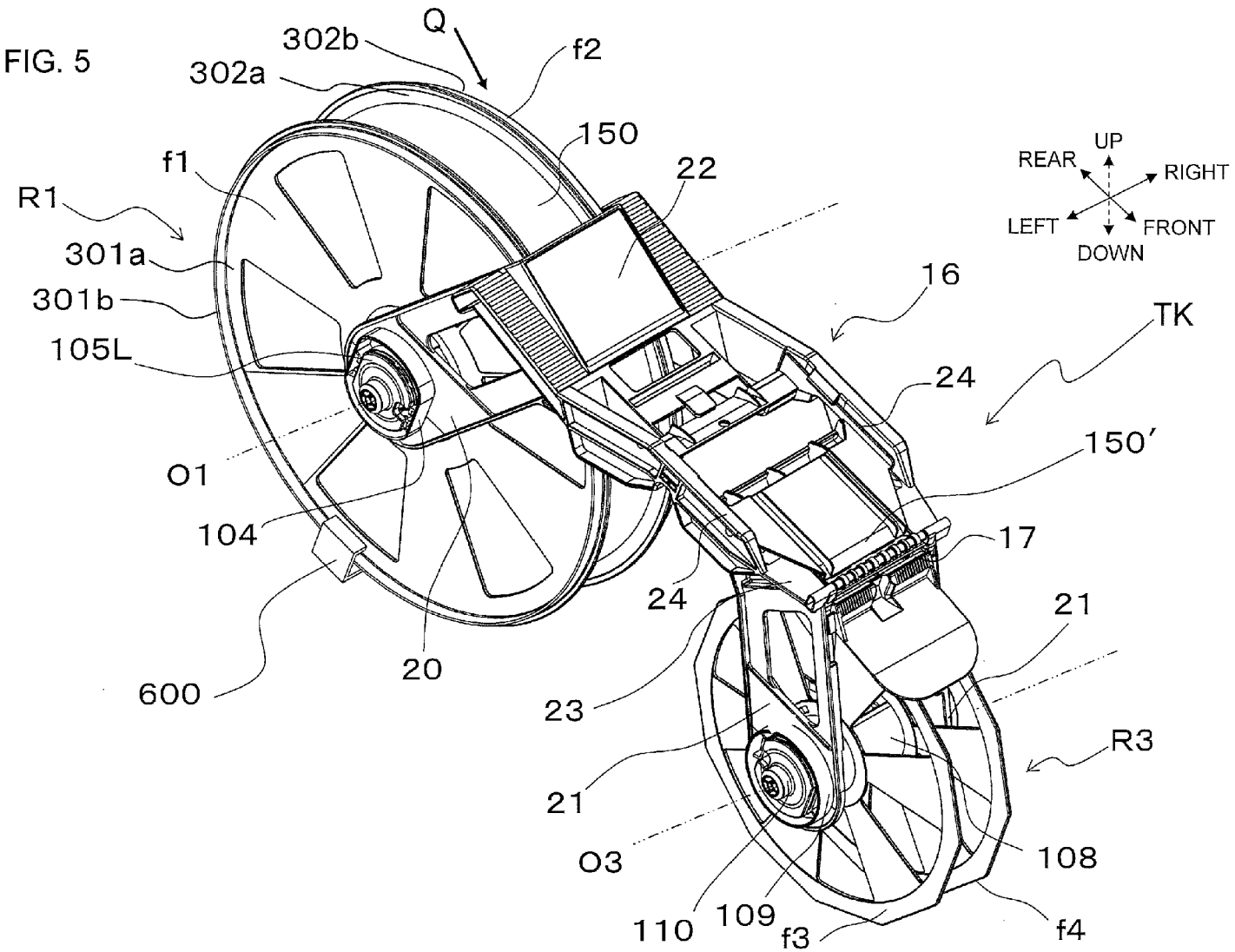
FIG. 5 is a perspective view showing the overall configuration of the tape cartridge.
Figure 6:
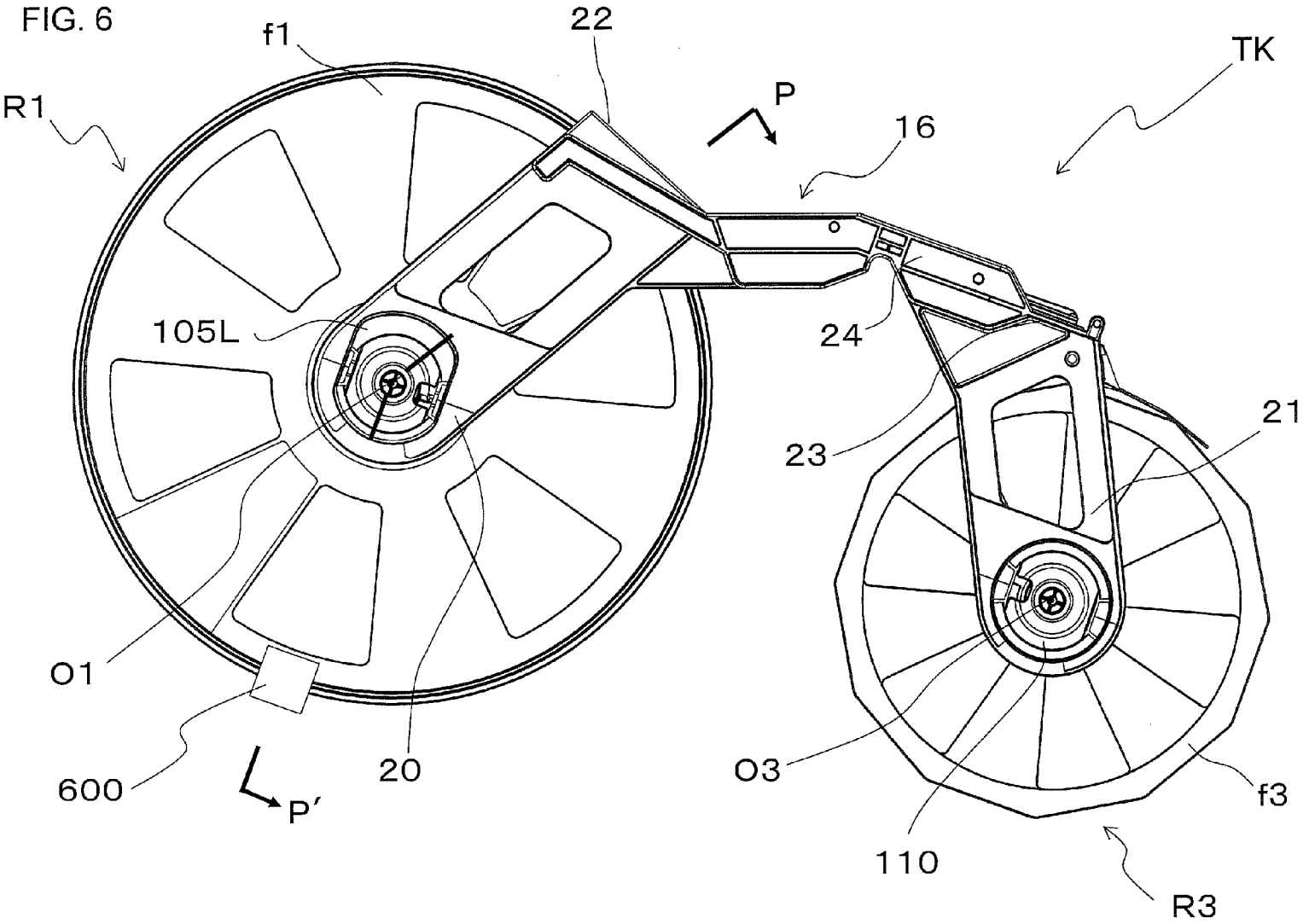
FIG. 6 is a side view showing the overall configuration of the tape cartridge.

That is, the tape cartridge TK comprises the above described print-receiving tape roll R1 and a coupling arm 16, as shown in FIGS. 5 and 6. The coupling arm 16 comprises a left and right pair of first bracket parts 20, 20 disposed on the rearward side, and a left and right pair of second bracket parts 21, 21 disposed on the frontward side.

The first bracket parts 20, 20 sandwich the above described print-receiving tape roll R1 from both the left and right sides along the axis O1 via a left and right pair of substantially circular-shaped flange parts f1, f2. Then, the first bracket parts 20, 20 hold the print-receiving tape roll R1 rotatably around the axis O1 with the tape cartridge TK mounted to the housing main body 2*a* (the detailed holding structure will be described later). These first bracket parts 20, 20 are connected by a first connecting part 22 that is extended substantially along the left-right direction on the upper end, avoiding interference with the outer diameter of the print-receiving tape roll R1. Note that the detailed shape of the flange parts f1, f2, one special characteristic of this embodiment, will be described later.

The print-receiving tape roll R1 is rotatable when the tape cartridge TK is mounted in the interior of the housing main body 2*a*. The print-receiving tape roll R1 winds a print-receiving tape 150 (comprising a print-receiving layer 154, a base layer 153, an adhesive layer 152, and a separation material layer 151 described later; refer to the enlarged view in FIG. 2) consumed by feed-out around the axis O1 in the left-right direction in advance.

The print-receiving tape roll R1 is received in the first storage part 3 from above by the mounting of the above described tape cartridge TK and stored with the axis O1 of the winding of the print-receiving tape 150 in the left-right direction. Then, the print-receiving tape roll R1, stored in the first storage part 3 (with the tape cartridge TK mounted), rotates in a predetermined rotating direction (a direction A in FIG. 2) inside the first storage part 3, thereby feeding out the print-receiving tape 150.

This embodiment illustrates a case where a print-receiving tape 150 having adhesiveness is used. That is, the print-receiving tape 150 is layered in the order of the print-receiving layer 154, the base layer 153, the adhesive layer 152, and the separation material layer 151, from one side in the thickness direction (upward side in FIG. 2) toward the other side (downward side in FIG. 2). The print-receiving layer 154 is a layer in which a desired print part 155 (refer to the enlarged partial view in FIG. 2) is formed by the heat transfer printing of ink from the above described printing head 11. The adhesive layer 152 is a layer for affixing the base layer 153 to a suitable adherend (not shown). The separation material layer 151 is a layer that covers the adhesive layer 152.

Note that, other than a tape that includes the adhesive layer 152 and the separation material layer 151 as described above, a tape that does not have adhesiveness (does not include the adhesive layer 152 or the separation material layer 151, such as a tape made of a fabric material, for example) may also be used (not shown) as the above described print-receiving tape 150. In the case of this tape, neither the peeling of the separation material layer 151 such as described later nor the generation of a separation material roll R3 is performed. In the following, the case of the print-receiving tape 150 having the above described adhesiveness is described as an example, unless particularly noted.

Feeding Roller and Printing Head

Returning to FIGS. 2-4, the above described feeding roller 12 is disposed on a middle upward side of the first storage part 3 and the second storage part 5 of the housing main body 2*a*. The feeding roller 12 is driven by a feeding motor M1 disposed in the interior of the housing main body 2*a* via a gear mechanism (not shown), thereby feeding the above described print-receiving tape 150 fed out from the print-receiving tape roll R1 stored in the first storage part 3 in a tape posture in which the tape-width direction is in the left-right direction.

Further, the above described head holding part 10 disposed on the first opening/closing cover 8*a* comprises the above described printing head 11. The printing head 11, as described above, is capable of moving relatively closer to or farther away from the feeding roller 12 by the pivoting of the first opening/closing cover 8*a* around the pivot axis K1. That is, the printing head 11 moves closer to the feeding roller 12 when the first opening/closing cover 8*a* is closed, and farther away from the feeding roller 12 when the first opening/closing cover 8*a* is opened. This printing head 11 is disposed in a position of the head holding part 10 that faces the area above the feeding roller 12, with the first opening/closing cover 8*a* closed, sandwiching the print-receiving tape 150 fed by the feeding roller 12 in coordination with the feeding roller 12. Accordingly, when the first opening/closing cover 8*a* is closed, the printing head 11 and the feeding roller 12 are disposed facing each other in the up-down direction. Then, the printing head 11 forms desired print on the print-receiving layer 154 of the print-receiving tape 150 sandwiched between the printing head 11 and the feeding roller 12 using an ink ribbon IB of an ink ribbon cartridge RK described later, thereby establishing a tape 150' with print.

Ink Ribbon Cartridge

Figure 7:
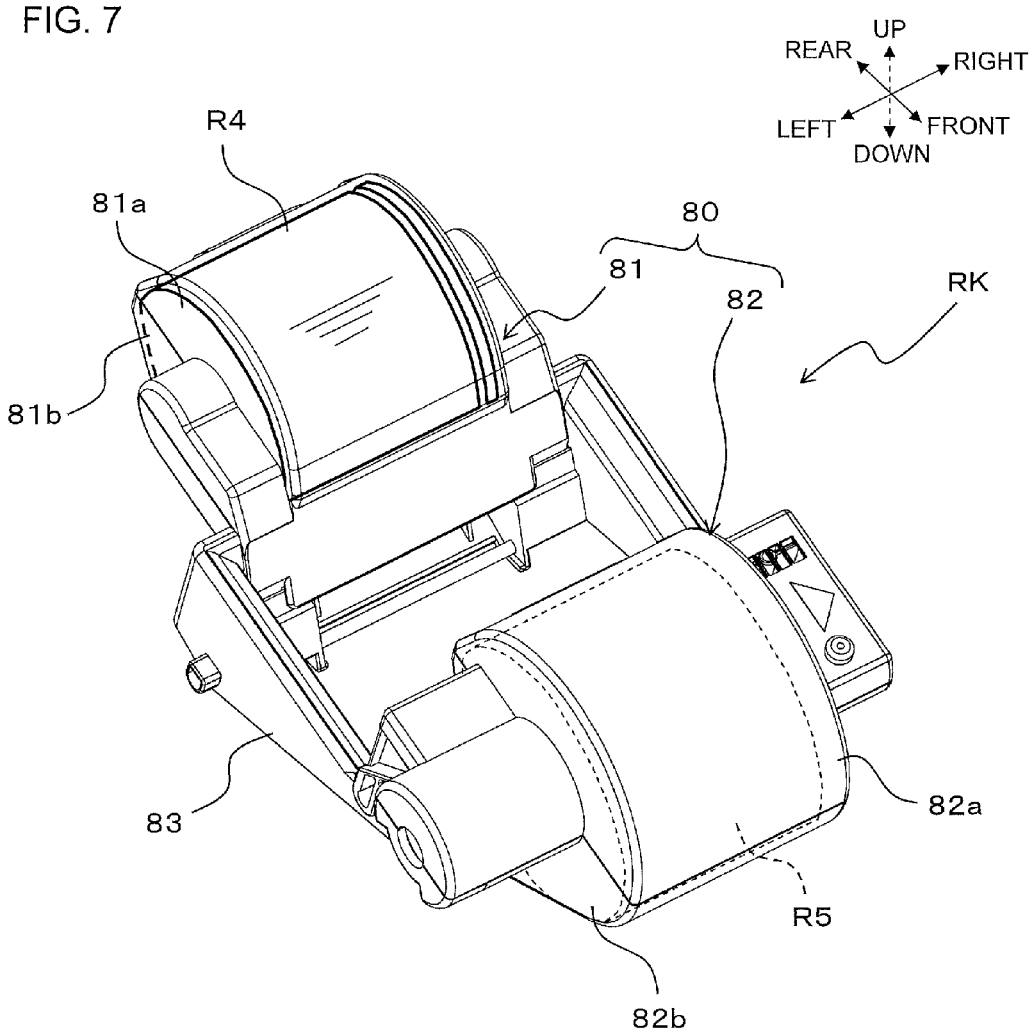
FIG. 7 is a perspective view from above showing the overall configuration of the ink ribbon cartridge.

As shown in FIG. 2 and FIG. 3, the ink ribbon cartridge RK is detachably mounted in a second predetermined position 14, which is below the first opening/closing cover 8*a* (when closed) and above the tape cartridge TK in the housing main body 2*a*. FIG. 7 shows the detailed structure of the ink ribbon cartridge RK.

As shown in FIG. 7, the ink ribbon cartridge RK comprises a cartridge housing 80, a ribbon feed-out roll R4 around which is wound the unused ink ribbon IB in manner that enables feed-out, and a ribbon take-up roll R5. The cartridge housing 80 comprises a rearward-side feed-out roll storage part 81, a frontward-side take-up roll storage part 82, and a coupling part 83 that couples both of these storage parts 81, 82. The coupling part 83 couples the above described take-up roll storage part 82 and the above described feed-out roll storage part 81 while exposing the above described ink ribbon IB fed out from the ribbon feed-out roll R4 to the outside of the cartridge housing 80.

The feed-out roll storage part 81 is configured by combining a substantially semi-cylindrical upper part 81*a* and lower part 81*b*. The ribbon feed-out roll R4 is rotatably supported inside the feed-out roll storage part 81, and rotates in a predetermined rotating direction (a direction D in FIG. 2) with the ink ribbon cartridge RK mounted, thereby feeding out the ink ribbon IB for print formation by the printing head 11.

The take-up roll storage part 82 is configured by combining a substantially semi-cylindrical upper part 82*a* and lower part 82*b*. The ribbon take-up roll R5 is rotatably supported inside the take-up roll storage part 82 and rotates in a predetermined rotating direction (a direction E in FIG. 2) with the ink ribbon cartridge RK mounted, thereby taking up the used ink ribbon IB after print formation.

That is, in FIG. 2, the ink ribbon IB fed out from the ribbon feed-out roll R4 is disposed further on the printing head 11 side of the print-receiving tape 150 sandwiched between the printing head 11 and the feeding roller 12, contacting the area below the printing head 11. Then, after the ink of the ink ribbon IB is transferred to the print-receiving layer 154 of the print-receiving tape 150 by the heat from the printing head 11 to execute print formation, the used ink ribbon IB is taken up by the ribbon take-up roll R5.

Separation Material Roll and Surrounding Area Thereof

As shown in FIG. 5, the coupling arm 16 of the tape cartridge TK comprises a peeling part 17 that includes a substantially horizontal slit shape, for example. This peeling part 17 is a position that peels the separation material layer 151 from the tape 150' with print fed out from the print-receiving tape roll R1 and fed to the frontward side. As shown in FIG. 2, the above described peeling part 17 peels the above described separation material layer 151 from the tape 150' with print on which print was formed as described above, thereby separating the separation material layer 151 and a tape 150" with print made of the other layers, i.e., the print-receiving layer 154, the base layer 153, and the adhesive layer 152. Note that, in a case where the aforementioned print-receiving tape 150 not having viscosity is used, the above described peeling is not performed since the separation material layer 151 and the adhesive layer 152 are not included, and the tape 150' with print on which print is formed as described above becomes the above described tape 150" with print (that does not include the adhesive layer 152) as is (not shown).

The tape cartridge TK, as shown in FIGS. 2, 5, and 6, comprises the above described separation material roll R3 formed by winding the above described peeled separation material layer 151 around a winding core 108 comprising an axis O3. That is, the separation material roll R3 is received in the above described second storage part 5 from above by the mounting of the aforementioned tape cartridge TK and stored with the axis O3 in the left-right direction. Then, the above described winding core 108, stored in the second storage part 5 (with the tape cartridge TK mounted), is driven by a separation sheet take-up motor M3 disposed on an interior substrate 2*b* of the housing main body 2*a* via a gear mechanism (not shown) and rotates in a predetermined rotating direction (a direction C in FIG. 2) inside the second storage part 5, thereby taking up the separation material layer 151.

At this time, as shown in FIG. 5, the above described second bracket parts 21, 21 of the tape cartridge TK are set so as to sandwich the above described winding core 108 (in other words, the separation material roll R3; hereinafter the same) from both the left and right sides along the axis O3 via a left and right pair of substantially circular-shaped flange parts f3, f4, holding the winding core 108 rotatably around the axis O3 with the tape cartridge TK mounted to the housing main body 2*a* (the details of the holding structure will be described later).

These second bracket parts 21, 21 are connected by a second connecting part 23 extended substantially along the left-right direction on the upper end. Then, the first bracket parts 20, 20 and the first connecting part 22 on the rearward side, and the second bracket parts 21, 21 and the second connecting part 23 on the frontward side are coupled by a left and right pair of roll coupling beam parts 24, 24.

Note that, FIG. 5 shows the state before the separation material layer 151 is wound around the winding core 108 and the separation material roll R3 is formed (the case of the unused tape cartridge TK). That is, FIG. 5 shows the substantially circular-shaped above described flange parts f3, f4 disposed so as to sandwich both width-direction sides of the separation material layer 151, and conveniently denotes the location where the separation material roll R3 is formed using the reference number "R3."

Tape Roll with Print and Surrounding Area Thereof

On the other hand, as shown in FIG. 2 and FIG. 4, a take-up mechanism 40 comprising a winding core 41 for sequentially winding the above described tape 150" with print is received in the above described third storage part 4 from above. The take-up mechanism 40 is stored so that it is supported rotatably around an axis O2 with the axis O2 of the winding of the tape 150" with print in the left-right direction. Then, with the take-up mechanism 40 stored in the third storage part 4, the above described winding core 41 is driven by an adhesive take-up motor M2 that is disposed in the interior of the housing main body 2*a* via a gear mechanism (not shown) and rotates in a predetermined rotating direction (a direction B in FIG. 2) inside the third storage part 4. With the arrangement, the winding core 41 takes up and layers the tape 150" with print, sequentially winding the tape 150" with print on an outer peripheral side of the winding core 41, forming a tape roll R2 with print.

Cutter Mechanism 30

Further, as shown in FIG. 2, a cutter mechanism 30 is disposed on the downstream side of the printing head 11 and the upstream side of the tape roll R2 with print, along the tape transport direction.

The cutter mechanism 30, while not shown in detail, comprises a movable blade and a carriage that supports the movable blade and is capable of travelling in the tape-width direction (in other words, the left-right direction). Then, the carriage travels by the driving of a cutter motor (not shown) and the movable blade moves in the tape-width direction, cutting the above described tape 150" with print in the width direction.

Overview of Operation of Tape Printer

Next, an overview of the operation of the tape printer 1 with the above described configuration will be described.

That is, when the tape cartridge TK is mounted in the above described first predetermined position 13, the print-receiving tape roll R1 is stored in the first storage part 3 positioned on the rearward side of the housing main body 2*a*, and the section on the axis O3 side (including the winding core 108) that forms the separation material roll R3 is stored in the second storage part 5 positioned on the frontward side. Further, the take-up mechanism 40 for forming the tape roll R2 with print is stored in the third storage part 4 positioned on the frontward side of the housing main body 2*a*.

At this time, when the feeding roller 12 is driven, the print-receiving tape 150 fed out by the rotation of the print-receiving tape roll R1 stored in the first storage part 3 is fed to the frontward side. Then, desired print is formed by the printing head 11 on the print-receiving layer 154 of the print-receiving tape 150 thus fed, thereby establishing the tape 150' with print. When the tape 150' with print on which print was formed is further fed to the frontward side and fed to the peeling part 17, the separation material layer 151 is peeled at the peeling part 17, establishing an adhesive tape 150" with print. The peeled separation material layer 151 is fed to the downward side, introduced to and wound inside the second storage part 5, forming the separation material roll R3.

On the other hand, the adhesive tape 150" with print (the tape 150' with print becomes the above described tape 150" with print as is if the print-receiving tape 150 not having viscosity is used as described above) from which the separation material layer 151 was peeled is further fed to the frontward side, introduced to the third storage part 4, and wound on the outer peripheral side of the take-up mechanism 40 inside the third storage part 4, thereby forming the tape roll R2 with print. At this time, the cutter mechanism 30 disposed on the transport direction downstream side (that is, the frontward side) cuts the adhesive tape 150" with print. With the arrangement, the adhesive tape 150" with print wound around the tape roll R2 with print can be cut based on a timing desired by the user and the tape roll R2 with print can be removed from the third storage part 4 after cutting.

Note that, at this time, although not explained by illustration, a shoot 15 (refer to FIG. 2) for switching the feeding path of the above described tape 150" with print between a side toward the tape roll R2 with print and a side toward the discharging exit (not shown) may be disposed. That is, the above described tape 150" with print after print formation may be discharged as is from the discharging exit (not shown) disposed on the second opening/closing cover 8*b* side, for example, of the housing 2 to the outside of the housing 2 without being wound inside the third storage part 4 as described above by switching the tape path in a switch operation of the shoot 15 using a switch lever (not shown).

Detailed Structure Near Winding Core

Next, the detailed structure of the winding core 103 and the winding core 108 disposed in the above described tape cartridge TK will be described in order.

Support Structure Details of Winding Core 103 of Print-Receiving Tape Roll

Figure 8:
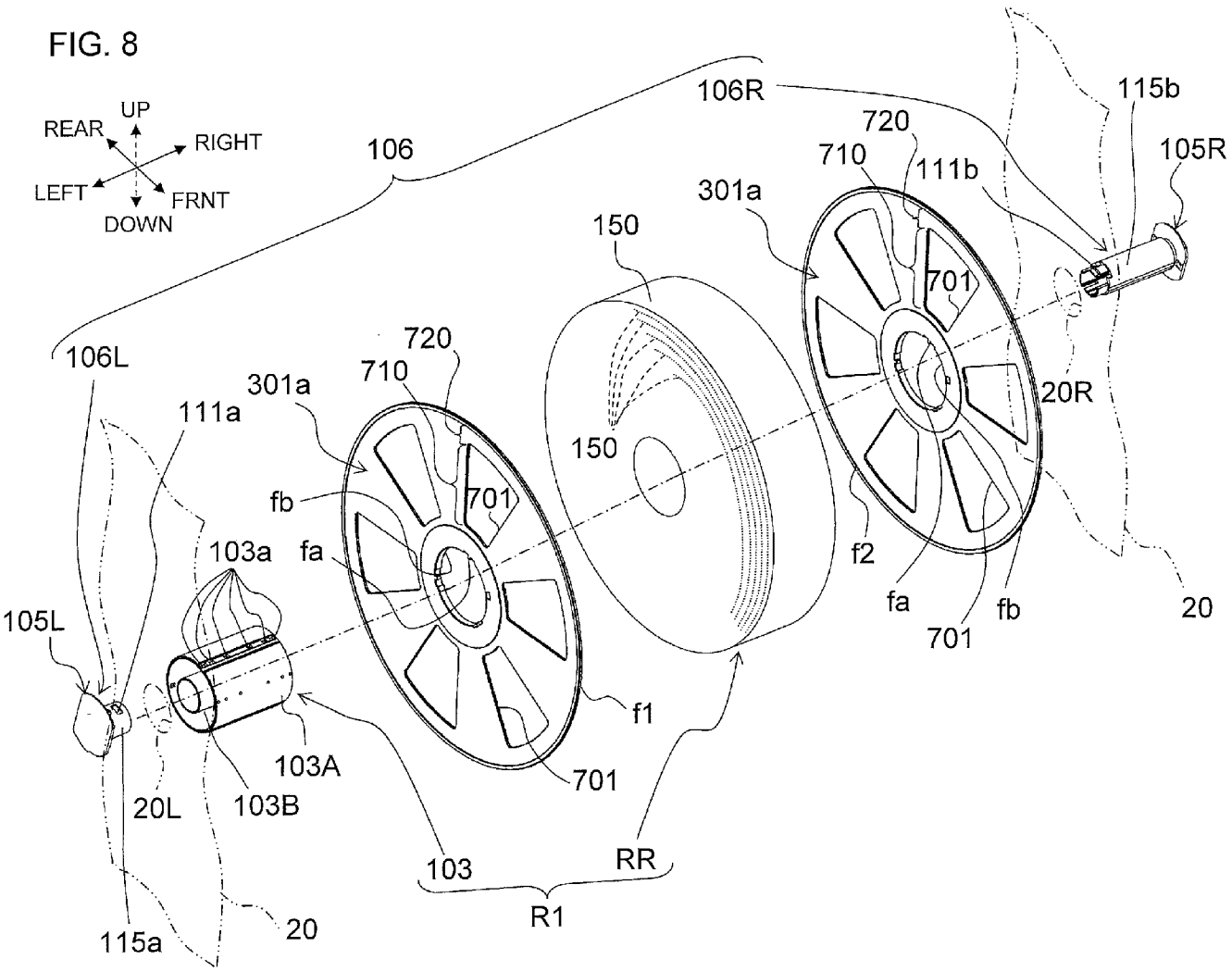
FIG. 8 is an exploded perspective view showing the support structure of the print-receiving tape roll.

As shown in FIG. 8, the print-receiving tape roll R1 comprises the above described winding core 103. That is, the above described print-receiving tape roll R1 is configured by winding the above described print-receiving tape 150 around the outer periphery of the winding core 103 in a manner that enables feed-out (by constituting a roll-shaped winding body RR).

The winding core 103 is rotatably supported by a fixed shaft member 106 wherein a left and right pair of a left fixed shaft part 106L and a right fixed shaft part 106R is directly connected to each other. That is, the winding core 103 comprises a double-tube structure with an outer cylinder 103A and an inner cylinder 103B. Then, a short cylinder part 115*a* positioned on the right-end side of the left fixed shaft part 106L is slidably inserted from the left side of the inner cylinder 103B. At this time, a through hole 20L (roughly shown in FIG. 8) comprising an inner diameter that is larger than the outer diameter of the short cylinder part 115*a* is disposed on the above described first bracket part 20 on the left side. Then, the short cylinder part 115*a* is passed through the through hole 20L and inserted into the inner cylinder 103B of the above described winding core 103 positioned on the opposite side (that is, the right side) via the first bracket part 20.

Similarly, a long cylinder part 115*b* positioned on the left-end side of the right fixed shaft part 106R is slidably inserted from the right side of the inner cylinder 103B. At this time, a through hole 20R (roughly shown in FIG. 8) comprising an inner diameter that is larger than the outer diameter of the long cylinder part 115*b* is disposed on the above described first bracket part 20 on the right side. Then, the long cylinder part 115*b* is passed through the through hole 20R and inserted into the inner cylinder 103B of the above described winding core 103 positioned on the opposite side (that is, the left side) via the first bracket part 20.

Subsequently, locking pieces 111*b* of the right fixed shaft part 106R are respectively engaged with locking holes 111*a* disposed in a plurality of circumferential-direction locations on the left fixed shaft part 106L, thereby coupling and integrating the left and right fixed shaft parts 106L, 106R. With the arrangement, the winding core 103 establishes the fixed shaft member 106 made of the left and right fixed shaft parts 106L, 106R as a fixed center axis and is slidably rotatable around that axis, between the left and right pair of first bracket parts 20, 20.

At this time, a plurality of locking holes 103*a* is formed on the front surface of the outer cylinder 103A along the axial direction. On the other hand, a circular opening fb is disposed on the center side of the flange parts f1, f2. A locking protrusion fa is formed on the inner periphery edge of a circular opening fb. Then, the respective locking protrusions fa of the flange parts f1, f2 are fit together with any of the locking holes 103*a* of the outer cylinder 103A, making it possible to fix the flange parts f1, f2 in positions corresponding to the various widths (wide width, narrow width) of the print-receiving tape 150 constituting the print-receiving tape roll R1 (refer to FIGS. 10, 11, 12, and 16 described later).

As described above, the short cylinder part 115*a* and the long cylinder part 115*b* of the left and right fixed shaft parts 106L, 106R constituting the above described fixed shaft member 106 are inserted (via an allowance) into the through holes 20L, 20R as described above. Nevertheless, these left and right fixed shaft parts 106L, 106R are non-rotatably engaged with the first bracket parts 20, 20 by positioning flange parts 105L, 105R respectively disposed therein. That is, each of the first bracket parts 20 comprises a first guide part 104 having a substantially oval shape near a lower end, as shown in FIG. 5. On the other hand, the above described positioning flange parts 105L, 105R comprise an overall substantially oval shape (slightly smaller than the first guide part 104) that includes two front and rear linear outer edge parts formed along the up-down direction (in other words, the direction of action of its own weight). Then, when the short cylinder part 115*a* is inserted into the through hole 20L as described above, the positioning flange part 105L is stored in the above described first guide part 104 of the left first bracket part 20 while the mutual orientations of the oval shapes are aligned. Similarly, when the long cylinder part 115*b* is inserted into the through hole 20R, the positioning flange part 105R is stored in the above described first guide part 104 of the right first bracket part 20 while the mutual orientations of the oval shapes are aligned. As a result, with the left and right positioning flange parts 105L, 105R stored in the first guide parts 104, 104, the left and right fixed shaft parts 106L, 106R are non-rotatably engaged with the left and right first bracket parts 20, 20.

With the above configuration, the flange parts f1, f2 and the winding core 103 are integrated, making rotation possible with respect to the fixed shaft member 106 locked by the first bracket parts 20, 20 between the left and right pair of first bracket parts 20. As a result, the print-receiving tape roll R1 is rotatably supported around the above described axis O1 with respect to the first bracket parts 20, 20, making it possible to feed out the print-receiving tape 150 by rotation.

Note that while FIG. 8 describes a structure in which the above described left and right positioning flange parts 105L, 105R having a flat plate shape are disposed as an example, the left and right positioning flange parts 105L, 105R comprising an axial end part having a substantially barrel shape may be used, as shown in FIGS. 5, 6, and the like.

Note that, in the above described FIG. 8, ribs 301*b*, 302*b* (described later) disposed in the flange parts f1, f2 are omitted and only the outlines of the simple disk-shaped flange parts f1, f2 comprising a flat plate part 301*a* are shown to avoid complexities in illustration.

Detailed Structure Near Axis of Separation Material Roll

Returning to FIG. 5, on the other hand, the separation material roll R3 also has a support structure similar to the above described print-receiving tape roll R1, though not shown in detail. That is, the separation material roll R3 comprises the above described winding core 108, and the separation material layer 151 peeled as described above is taken up and wound around the outer periphery of the winding core 108 (the roll-shaped winding body is configured), thereby constructing the above described separation material roll R3.

The winding core 108 is rotatably supported by a fixed shaft member 110. The winding core 108 is a double-tube structure with an outer cylinder and an inner cylinder, similar to the above described winding core 103. At this time, a through hole (not shown) comprising an inner diameter that is larger than the outer diameter of the above described outer cylinder is respectively disposed on the left and right above described second bracket parts 21, 21. Then, a shaft main body part (a section equivalent to the above described short cylinder part 115*a* and long cylinder part 115*b*; not shown) of the fixed shaft member 110 is passed through the through hole and slidably inserted into the inner cylinder of the above described winding core 108. With the arrangement, the winding core 108 establishes the above described fixed shaft member 110 as the fixed center axis and is slidably rotatable around that axis, between the left and right pair of second bracket parts 21, 21.

At this time, a plurality of locking holes is formed along the axial direction, similar to the locking holes 103*a* of the above described winding core 103, on the front surface of the outer cylinder of the above described winding core 108. On the other hand, locking protrusions (not shown) similar to the locking protrusions fa of the above described flange parts f1, f2 are formed on the center side of the flange parts f3, f4. Then, the respective above described locking protrusions of the flange parts f3, f4 are fit together with any of the above described locking holes of the outer cylinder of the above described winding core 108, making it possible to fix the flange parts f3, f4 to positions corresponding to the width of the separation material layer 151 constituting the separation material roll R3 (in other words, the width of the print-receiving tape 150).

With the above configuration, the flange parts f3, f4 and the winding core 108 are integrated, making rotation possible with respect to the fixed shaft member 110, between the left and right pair of second bracket parts 21, 21. With the arrangement, the separation material roll R3 is rotatably supported around the above described axis O3 with respect to the second bracket parts 21, 21. At this time, the fixed shaft member 110 is operably coupled to the separation sheet take-up motor M3 via a gear mechanism (not shown), and rotates by the driving force from the separation sheet take-up motor M3, making it possible to take up the above described separation material layer 151 peeled from the above described print-receiving tape 150 on the winding core 108.

Control System

Figure 9:
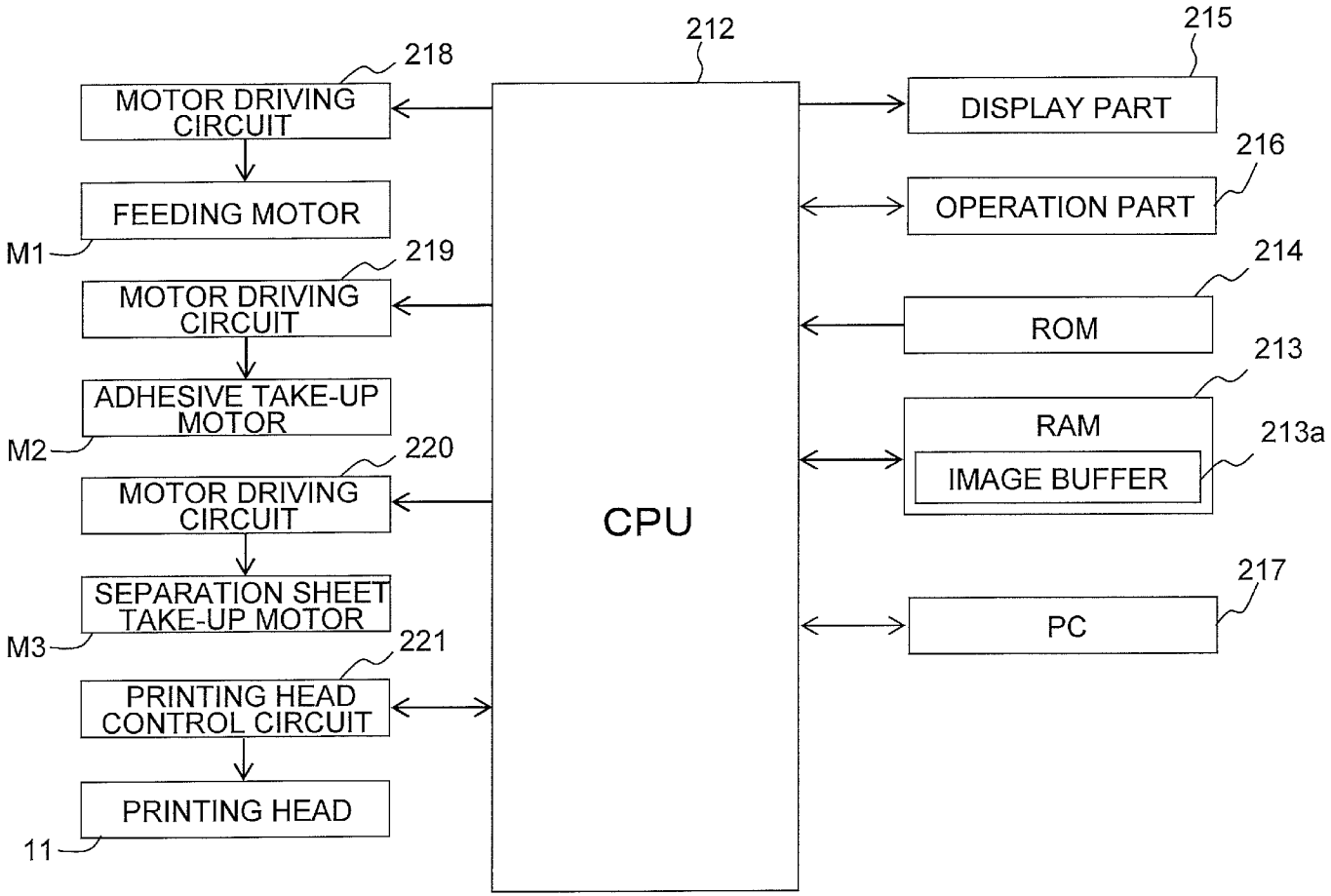
FIG. 9 is a functional block diagram showing the configuration of the control system of the tape printer.

Next, the control system of the tape printer 1 will be described using FIG. 9. In FIG. 9, the tape printer 1 comprises a CPU 212 that constitutes a computing part that performs predetermined computations. The CPU 212 is connected to a RAM 213 and a ROM 214. The CPU 212 performs signal processing in accordance with a program stored in advance in the ROM 214 while utilizing a temporary storage function of the RAM 213, and controls the entire tape printer 1 accordingly.

Further, the CPU 212 is connected to a motor driving circuit 218 that controls the driving of the above described feeding motor M1 that drives the above described feeding roller 12, a motor driving circuit 219 that controls the driving of the above described adhesive take-up motor M2 that drives the above described winding core 41, a motor driving circuit 220 that controls the driving of the above described separation sheet take-up motor M3 that drives the above described winding core 108, a printing head control circuit 221 that controls the conduction of the heating elements of the above described printing head 11, a display part 215 (not shown in FIG. 1 and the like) that performs suitable displays, and an operation part 216 (not shown in FIG. 1 and the like) that permits suitable operation input by the user. Further, while the CPU 212 is connected to a PC 217 serving as an external terminal in this example, the CPU 212 does not need to be connected in a case where the tape printer 1 operates alone (since it is a so-called stand-alone type).

The ROM 214 stores control programs for executing predetermined control processing. The RAM 213 comprises an image buffer 213*a* that expands print data of an image data format received from the above described operation part 216 (or the above described PC 217), for example, into dot pattern data and stores the data for printing in a desired print area of the above described print-receiving layer 154. The CPU 212 prints one image corresponding to the above described dot pattern data stored in the image buffer 213*a* on the print-receiving tape 150 by the printing head 11 (repeatedly along the tape longitudinal direction) while feeding out the print-receiving tape 150 by the feeding roller 12, based on the above described control programs.

Detailed Structure of Roll Flange Part

The special characteristic of this embodiment, which is the basic configuration and operation such as described above, lies in the structure for suppressing roll deformation (described later) disposed in the flange parts f1, f2 and the coupling arm 16 disposed in the above described print-receiving tape roll R1. In the following, details of the structure will be described in order using a comparison example.

Wide Tape and Narrow Tape

Figure 10:
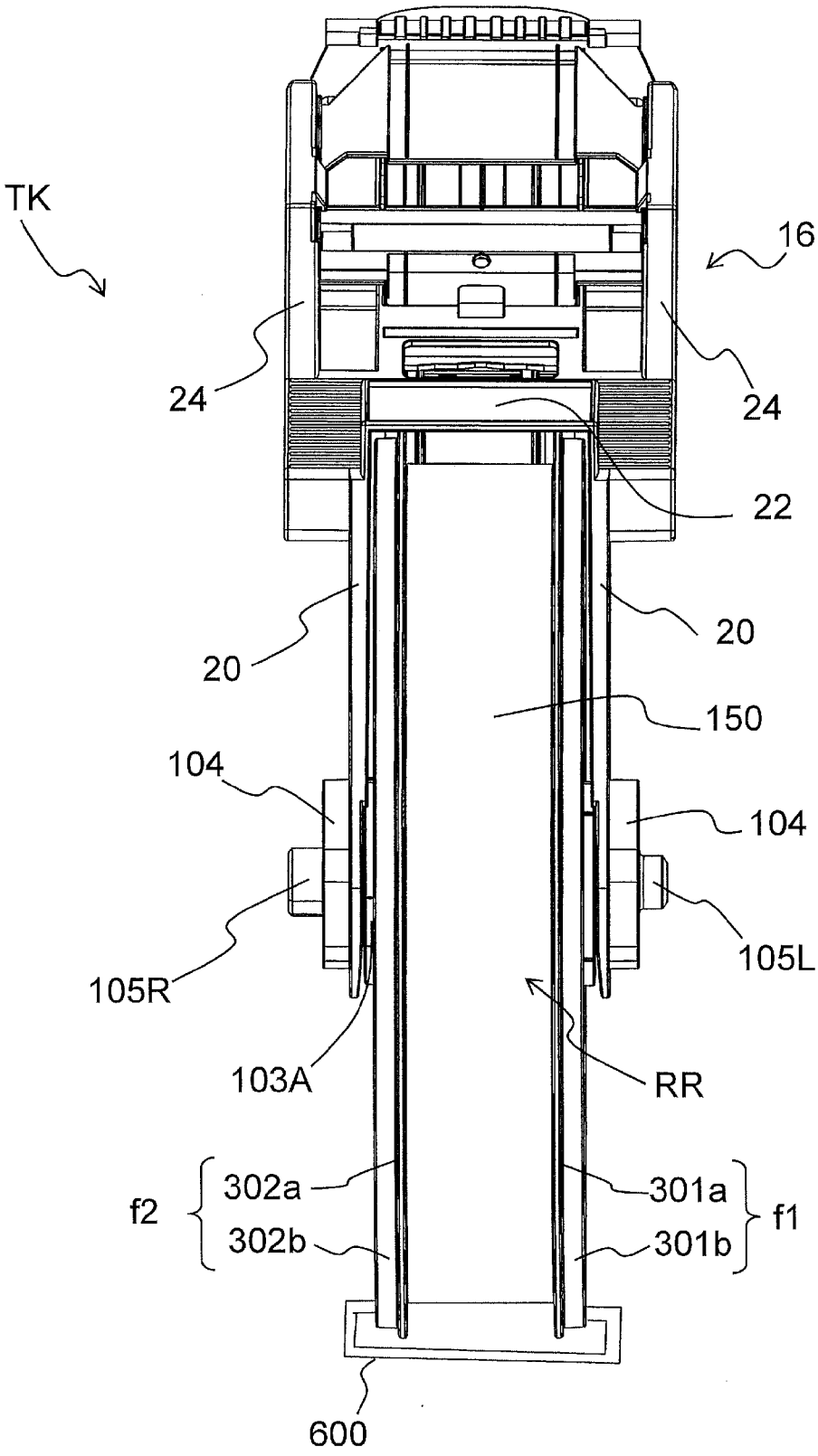
FIG. 10 is an arrow view showing the tape cartridge comprising a print-receiving tape having a wide width, as viewed from a direction Q in FIG. 5.
Figure 11:
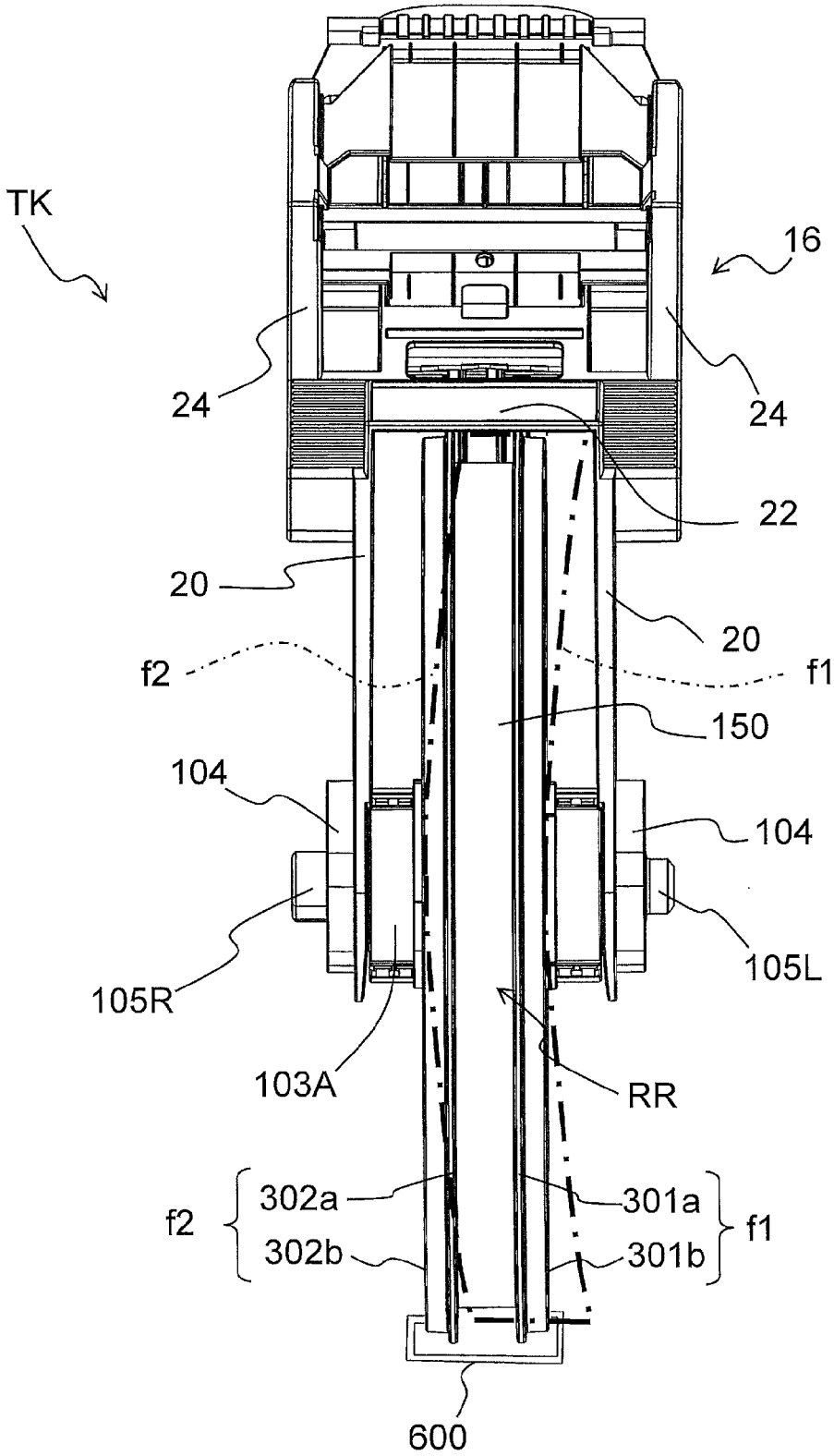
FIG. 11 is an arrow view showing the tape cartridge comprising a print-receiving tape having a narrow width, as viewed from the direction Q.

FIG. 10 shows a perspective view as viewed from the direction of an arrow Q in FIG. 5. Based on the structure of the aforementioned winding core 103, according to this embodiment, the flange parts f1, f2 are fixed to positions corresponding to a width (wide/narrow width) of the print-receiving tape 150. The examples shown in FIG. 10 and the above described FIG. 5 illustrate a case where the print-receiving tape 150 having a wide width is used. In contrast, FIG. 11 shows a view corresponding to the above described FIG. 10 in a case where the print-receiving tape 150 having a narrow width is used.

One special characteristic of this embodiment lies in the detailed structure of the flange parts f1, f2 having a substantially disk shape. As shown in the above described FIG. 10, FIG. 11, and FIG. 12 corresponding to FIG. 10, the flange part f1 disposed on the left side comprises a flat plate part 301*a*, which is a substantially circular-shaped flat plate, and a rib 301*b* that further protrudes from this flat plate part 301*a* to the left side and faces the right side of the above described first bracket 20 on the left side. Note that this rib 301*b* has an overall substantially ring shape (refer to FIG. 5). Similarly, the flange part f2 disposed on the right side comprises a flat plate part 302*a*, which is a substantially circular-shaped flat plate, and a rib 302*b* that further protrudes from this flat plate part 302*a* to the right side and faces the left side of the above described first bracket 20 on the right side. Note that this rib 302*b* also has an overall substantially ring shape (refer to FIG. 5). The flat plate parts 301*a*, 302*a* of the respective flange parts f1, f2, as shown in the aforementioned FIG. 8, comprise a first area 710 in which a substantially fan-shaped through hole 701 is disposed on an equal interval in a circumferential direction, and a substantially flat plate shaped second area 720 positioned on a radial-direction outside of the first area 710.

Roll Deformation by Tape Displacement

Figure 13:
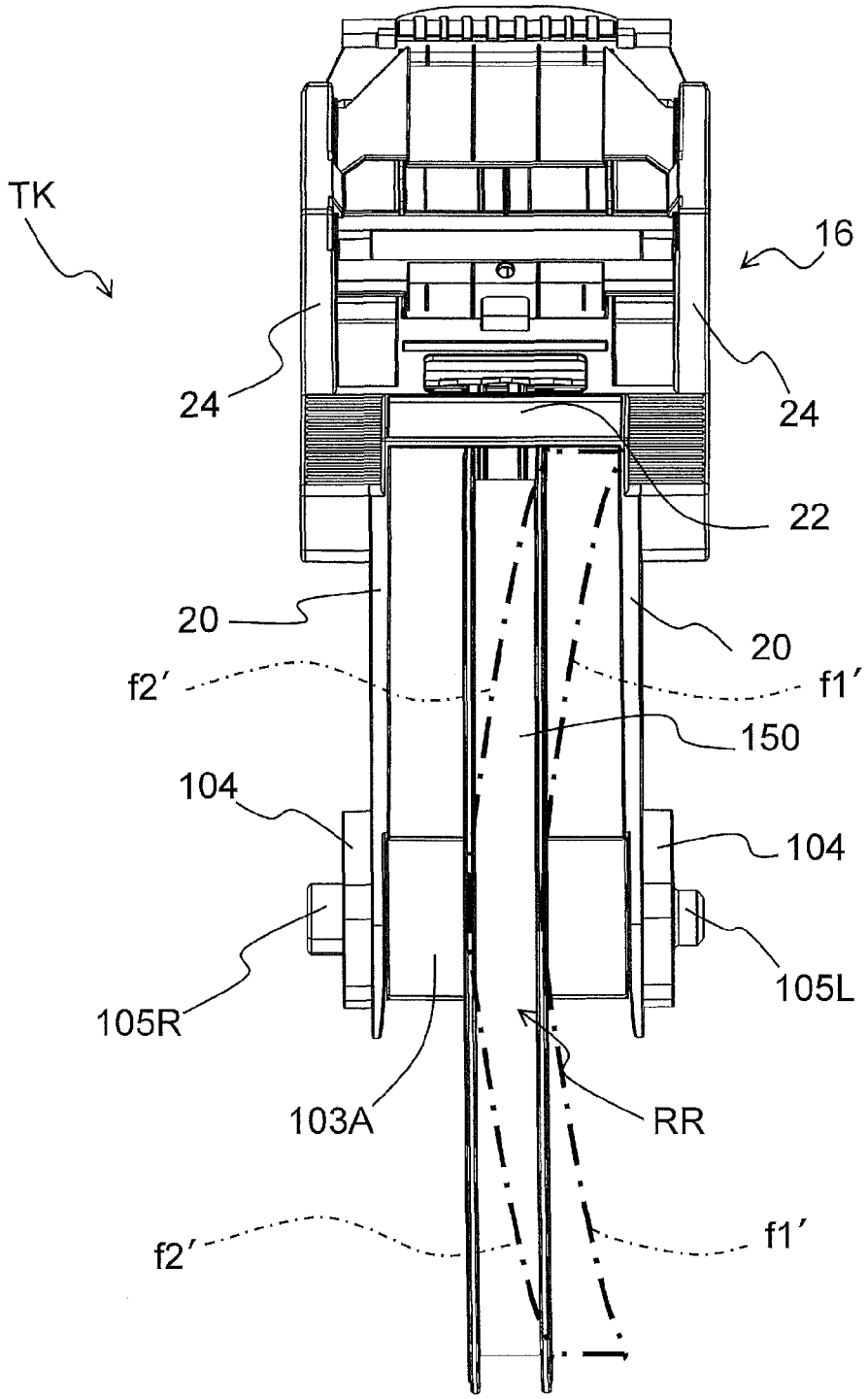
FIG. 13 is a view corresponding to the above arrow view showing a comparison example comprising a flange having a simple disk shape.

Next, the above described roll deformation will be described using a comparison example. According to the comparison example shown in FIG. 13, flange parts f1', f2' having a simple disk shape (not comprising the above described rib) are disposed in place of the above described flange parts f1, f2. Here, as already described, in the roll-shaped winding body RR of the print-receiving tape roll R1, the print-receiving tape 150 is sequentially wound from the inside to the outside in the radial direction, and normally, as shown in the aforementioned FIG. 8 as well, both width-direction end positions (in other words, the width-direction center positions) of the tape are mutually aligned in all layers of the wound print-receiving tape 150. Nevertheless, depending on the material of the print-receiving tape 150 (such as a case of a print-receiving tape having viscosity as described above, for example), even if both width-direction end positions are initially in the above described aligned state, displacement in the above described tape-width direction may occur in each layer as a result of temperature and humidity conditions during storage.

Figure 14A:
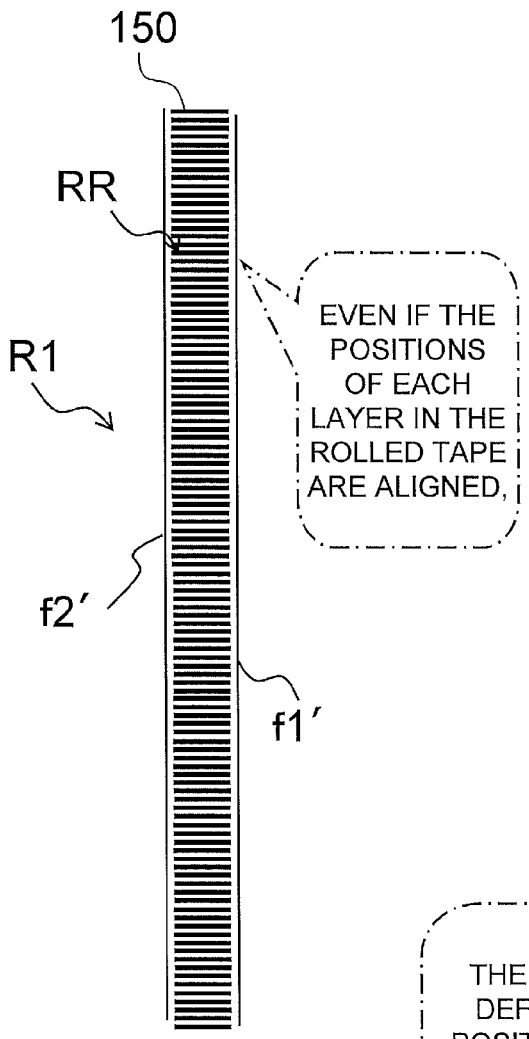
FIG. 14A is an explanatory view for explaining roll deformation resulting from tape displacement in the comparison example.
Figure 14B:
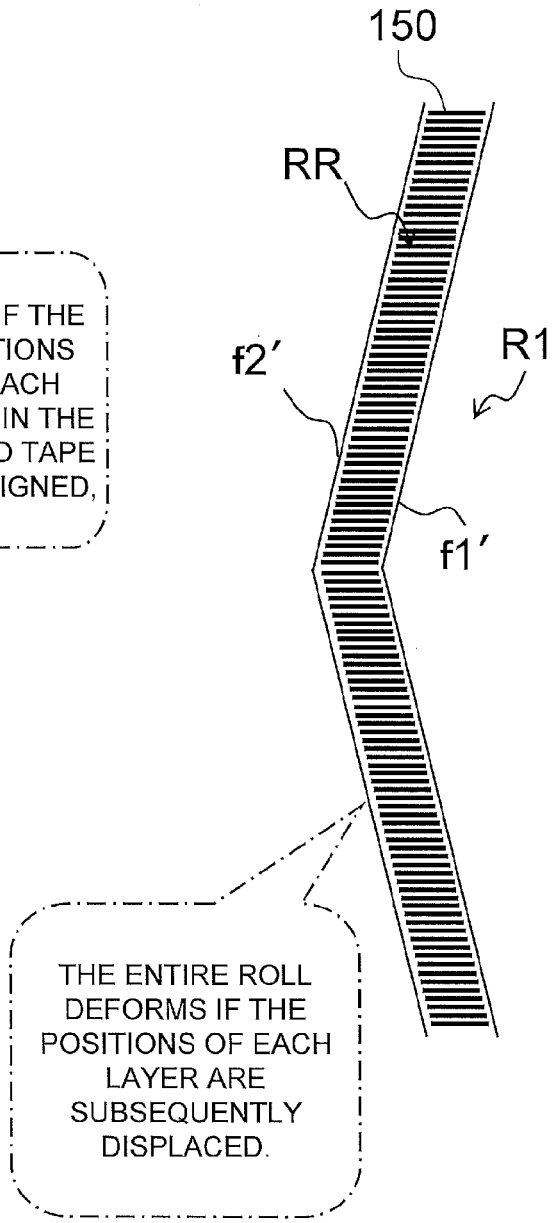
FIG. 14B is an explanatory view for explaining roll deformation resulting from tape displacement in the comparison example.

In such a case, the occurrence of the above described displacement cannot be suppressed by the flange parts f1', f2' having a simple disk shape as in the above described comparison example (refer to FIGS. 14A and 14B). With the arrangement, irregular winding may occur in the roll-shaped winding body RR, causing significant deformation of the print-receiving tape roll R1 as a result, as shown by the two-dot chain line in FIG. 13. Further, even in a case where deformation resulting from the above described temperature and humidity conditions does not occur (a case where the print-receiving tape is made of a fabric material that does not have viscosity or the like, for example), displacement and irregular winding of the print-receiving tape 150 similar to that described above may occur due to impact during handling or the like, resulting in deformation of the print-receiving tape roll R1 similar to the above.

Rib Action

In response, in this embodiment, the ribs 301*a*, 301*b* that protrude to the left side and right side (in other words, the outward sides in the axial direction) are respectively disposed on the flange parts f1, f2 of the print-receiving tape roll R1, and face the left and right first bracket parts 20, 20, as described above. With the arrangement, as the one example of the case of the narrow tape is shown in FIG. 11, even if the entire print-receiving tape roll R1 is about to deform as described above, the above described ribs (the rib 301*b* in the example shown) contact the first bracket part 20, suppressing further deformation (refer to the two-dot chain line in FIG. 11).

Arrangement of Boss on First Connecting Part

Figure 15:
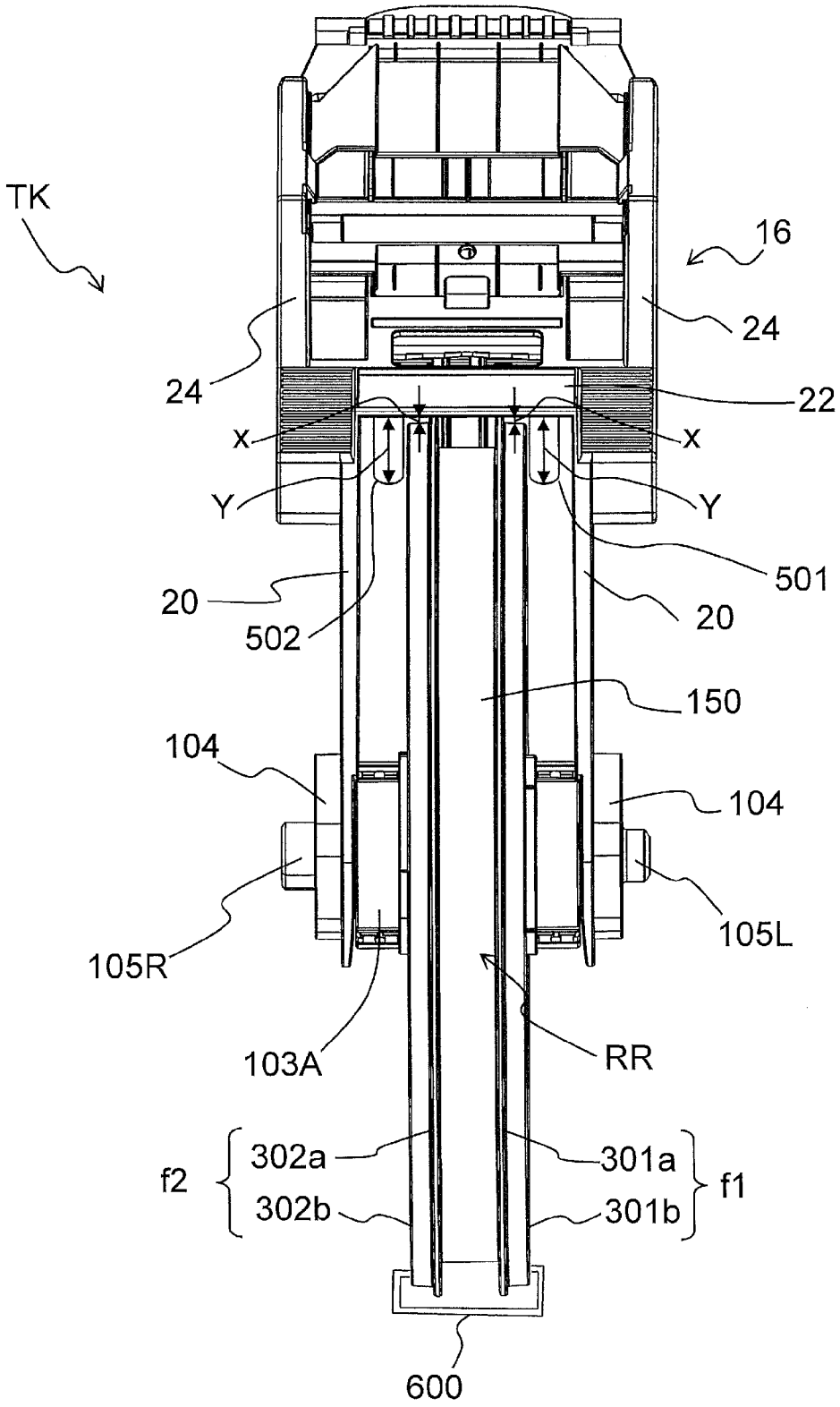
FIG. 15 is a view corresponding to the above arrow view in a case where the tape cartridge comprises the print-receiving tape having a narrow width and a boss is further disposed on the coupling arm.
Figure 16:
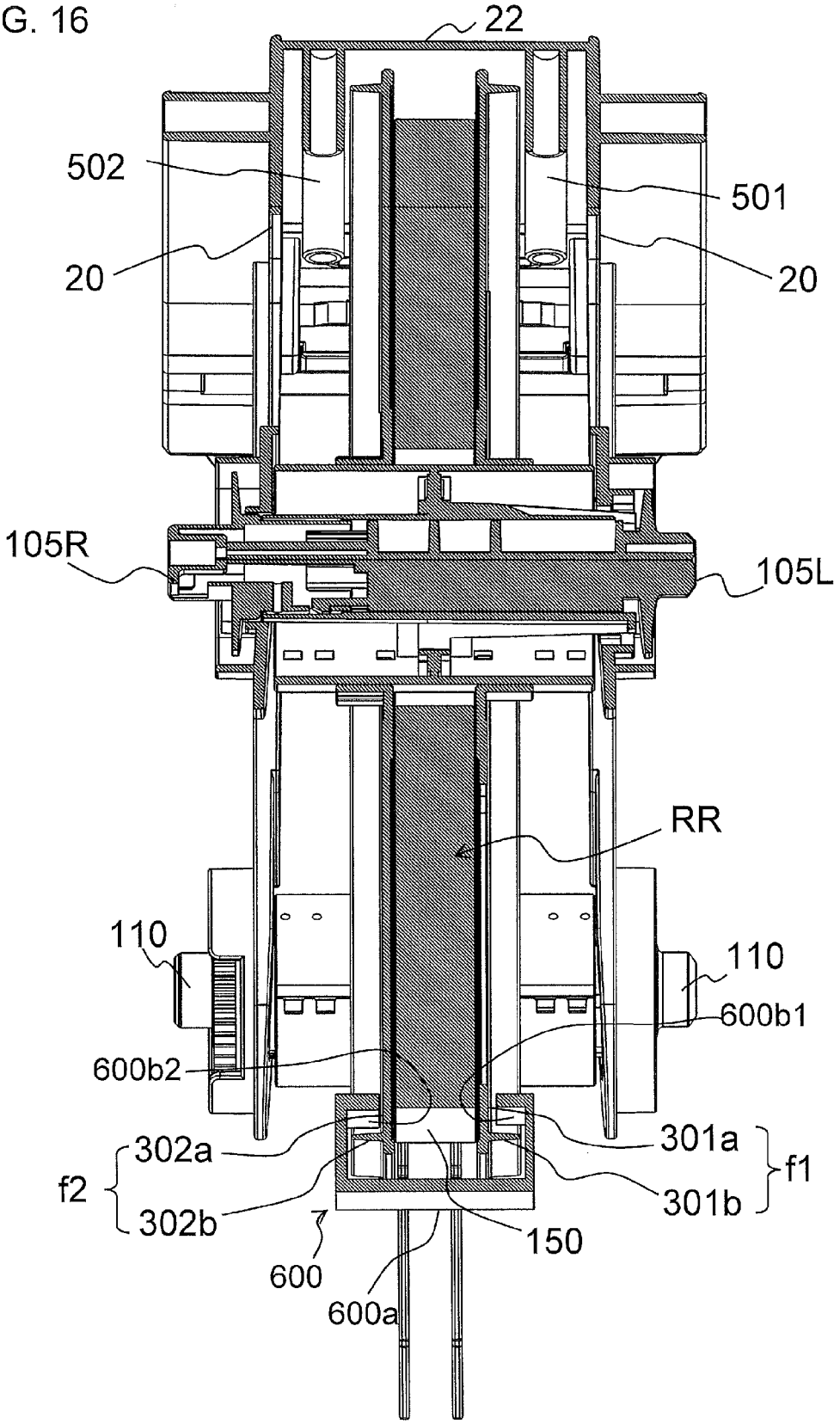
FIG. 16 is a cross-sectional view corresponding to the above cross-section P-P', showing the tape cartridge with the structure shown in FIG. 15.

Here, in a case where the print-receiving tape 150 having the above described narrow width is disposed, for example, a protruding part from the coupling arm 16 side may also be disposed in addition to the ribs 301*b*, 302*b* disposed as described above. FIG. 15 shows an example of such a structure. Note that FIG. 16 shows a cross-sectional view corresponding to the cross-section P-P' in the above described FIG. 6, in the structure in FIG. 15.

In the example shown in FIG. 15, bosses 501, 502 (having a substantially cylinder shape in this example) that protrude toward the inside along the radial direction of the roll are newly disposed on the above described first connecting part 22, in the structure shown in FIG. 10. The boss 501 is disposed on the left-side section of the first connecting part 22 and comes close to the left side of the radial-direction outer edge of the above described print-receiving tape roll R1 while facing the axial direction (the left-right direction in FIG. 15; specifically, protrudes between the rib 301*b* of the above described flange part f1 and the left-side first bracket part 20). At this time, a protruding amount Y from the first connecting part 22 of the boss 501 is greater than a distance x between the rib 301*b* and the above described first connecting part 22.

The boss 502 is disposed on the right-side section of the first connecting part 22 and comes close to the right side of the radial-direction outer edge of the above described print-receiving tape roll R1 while facing the axial direction (the left-right direction in FIG. 15; specifically, protrudes between the rib 302*b* of the above described flange part f2 and the right-side first bracket part 20). At this time, similar to the above, the protruding amount Y from the first connecting part 22 of the boss 502 is greater than the distance x between the rib 302*b* and the above described first connecting part 22.

With the arrangement, even if the entire print-receiving tape roll R1 is about to deform on one side (or the other side) in the axial direction as described above, the above described bosses 501, 502 contact the above described outer edge (that is, the rib 301*b* of the flange part f1 or the rib 302*b* of the flange part f2) of the entire print-receiving tape roll R1 that is about to deform, suppressing further deformation. As a result, it is possible to more reliably suppress deformation of the print-receiving tape roll R1.

Arrangement of Protrusion on Bracket

Further, in a case where the print-receiving tape 150 having the above described wide width is disposed, for example, protrusions 401, 402 (refer to FIG. 12) from the above described first bracket part may also be disposed in addition to the ribs 301*b*, 302*b* disposed as described above.

Figure 12:
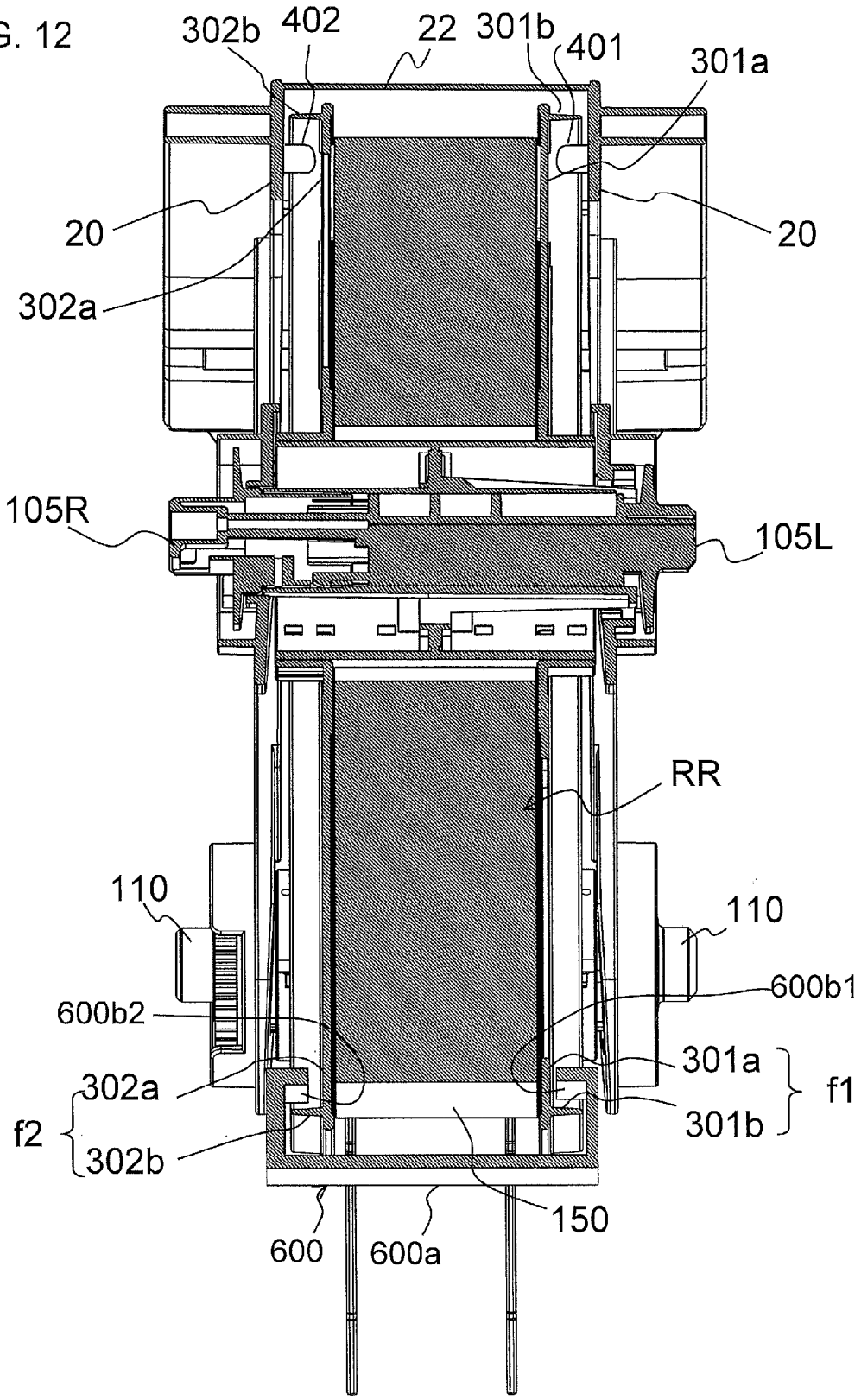
FIG. 12 is a cross-sectional view of a cross-section P-P' in FIG. 6, showing the tape cartridge comprising the print-receiving tape having a wide width.

In the example shown in FIG. 12, the above described protrusion 401 that protrudes to the right side and faces the left side of the print-receiving tape roll R1 (specifically, protrudes toward the above described second area 720 of the flat plate part 301*a* of the above described flange part f1) is disposed on the left-side first bracket part 20. Further, the above described protrusion 402 that protrudes to the left side and faces the left side of the print-receiving tape roll R1 (specifically, protrudes toward the above described second area 720 of the flat plate part 302*a* of the above described flange part f2) is disposed on the right-side first bracket part 20. Note that, at this time, as shown in FIG. 12, the above described protrusion 401 and the above described rib 301*b* are disposed in positions that are mutually offset in the radial direction of the above described print-receiving tape roll R1 so as to not face each other in the above described axial direction (the left-right direction in FIG. 12). Similarly, the above described protruding part 402 and the above described rib 302*b* are disposed in positions that are mutually offset in the radial direction of the above described print-receiving tape roll R1 so as to not face each other in the above described axial direction (the left-right direction in FIG. 12).

Thus, even if the entire print-receiving tape roll R1 is about to deform on one side (or the other side) in the axial direction as described above, the above described protrusions 401, 402 contact the print-receiving tape roll R1 (that is, the flat plate part 301*a* of the flange part f1 or the flat plate part 302*a* of the flange part f2) that is about to deform, suppressing further deformation. As a result, it is possible to more reliably suppress deformation of the print-receiving tape roll R1.

Sliding Clip

Figure 17:
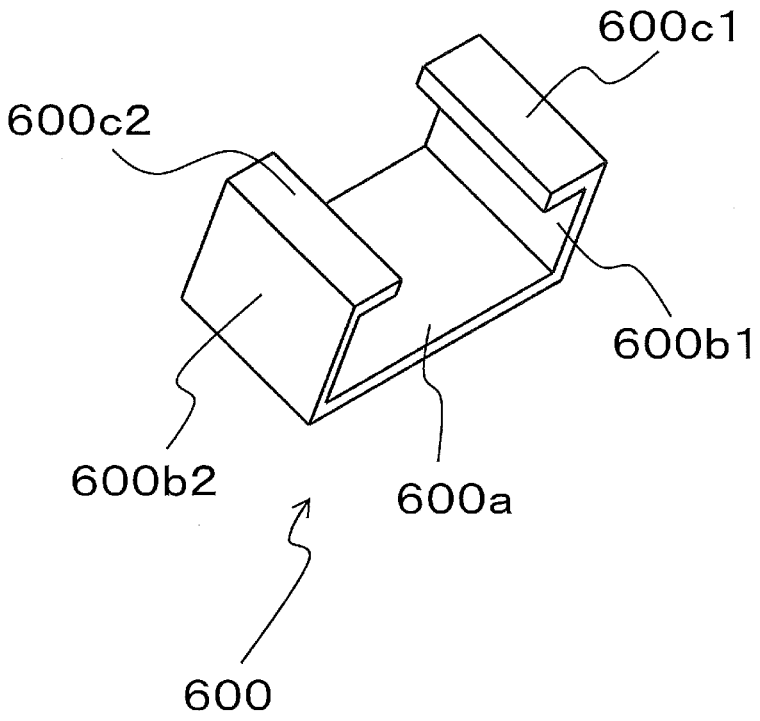
FIG. 17 is an enlarged perspective view showing the detailed structure of the sliding clip.

Further, as another special characteristic of this embodiment, a sliding clip 600 is disposed so as to extend across the above described flange parts f1, f2 (refer to FIGS. 5, 6, and the like). FIG. 17 shows an enlarged perspective view indicating the detailed structure of this sliding clip 600. As shown in FIG. 17, the sliding clip 600 has a substantial U-shape, and comprises a bottom wall part 600*a* that is the bottom area of the U-shape, left- and right-side wall parts 600*b*1, 600*b*2 that are the side parts of both the left and right sides of the U-shape, and left and right engaging wall parts 600*c*1, 600*c*2. The above described left-side wall part 600*b*1 is disposed on the left-side (right rearward side in FIG. 17) end of the bottom wall part 600*a* so as to be substantially orthogonal to the bottom wall part 600*a*. Then, the above described left engaging wall part 600*c*1 is further disposed on an opposite-side end of the above described bottom wall part 600*a* of the left-side wall part 600*b*1 so as to be substantially orthogonal to the left-side wall part 600*b*1. Similarly, the above described right-side wall part 600*b*2 is disposed on the right-side (left frontward side in FIG. 17) end of the bottom wall part 600*a* so as to be substantially orthogonal to the bottom wall part 600*a*. Then, the above described right engaging wall part 600*c*2 is further disposed on an opposite-side end of the above described bottom wall part 600*a* of the right-side wall part 600*b*2 so as to be substantially orthogonal to the right-side wall part 600*b*2.

When the sliding clip 600 with the above described structure is disposed so as to extend across the above described flange parts f1, f2, the left engaging wall part 600*c*1 engages with the above described rib 301*b* of the flange part f1, and the right engaging wall part 600*c*2 engages with the above described rib 302*b* of the flange part f2, thereby engaging so as to extend across the above described flange parts f1, f2 overall. Then, when the print-receiving roll R1 rotates, rotating the flange parts f1, f2, as described above, the left engaging wall part 600*c*1 slides with respect to the above described rib 301*b* and the right engaging wall part 600*c*2 slides with respect to the above described rib 302*b*, thereby stopping at predetermined locations without rotating along with the flange parts f1, f2. At this time, the sliding clip 600 may be stopped at the bottommost part of the flange parts f1, f2 in the direction of action of its own weight by its weight, and may be positioned so as to not rotate by a suitable position or member disposed on the housing 2 side when the tape cartridge TK is stored inside the housing 2 as described above.

Advantages of this Embodiment

As described above, in this embodiment, even if the entire print-receiving tape roll R1 is about to deform due to the aforementioned tape displacement, the ribs 301*b*, 302*b* of the flange parts f1, f2, the bosses 501, 502 of the first connecting part 22, and the protrusions 401, 402 suppress the deformation of the print-receiving tape roll R1. With the arrangement, the integrity of the print-receiving tape roll can be maintained.

Further, in particular, in this embodiment, the sliding clip 600 is disposed across the flange parts f1, f2, making it possible to suppress an increase in the spacing between the above described two flange parts f1, f2 caused by the aforementioned deformation. As a result, according to this as well, the deformation of the print-receiving tape roll R1 is suppressed, making it possible to maintain integrity. Further, this sliding clip 600 is slidably disposed on both of the flange parts f1, f2, resulting also in the advantage of the capability of suppressing interference with the print-receiving tape 150 when the print-receiving tape 150 is fed out by the rotation of the print-receiving tape roll R1, ensuring smooth repeated operation.

Note that while, in the above, the included separation material layer 151 is peeled to generate the separation material roll R3 in the case where the print-receiving tape 150 having viscosity is used, the present disclosure is not limited thereto. That is, the print-receiving tape 150 in which the separation material layer 151 has been omitted from the above described print-receiving tape 150 may also be used. In this case, similar to when the print-receiving tape 150 not having the above described viscosity is used, the behavior is one in which the separation material roll R3 is not generated.

Note that descriptions such as "orthogonal," "parallel," "planar," and the like in the above explanations are not made in a strict sense. That is, the terms "orthogonal," "parallel," and "planar" mean "substantially orthogonal," "substantially parallel," and "substantially planar," allowing design and manufacturing tolerances and differences.

Further, descriptions such as "identical," "equal," "different," and the like for outer appearance dimensions and sizes in the above explanations are not made in a strict sense. That is, the terms "identical," "equal," and "different" mean "substantially identical," "substantially equal," and "substantially different," allowing design and manufacturing tolerances and differences.

Note that, in the above, the arrows shown in FIG. 9 denote an example of signal flow, but the signal flow direction is not limited thereto.

Further, other than that already stated above, techniques based on the above described embodiments and each of the modifications may be suitably utilized in combination as well.

What is claimed is:

1. A medium cartridge comprising:

a recording medium roll with a long recording medium wound around an axis;

a support member that rotatably supports said recording medium roll; and at least one of first protruding parts that are disposed on said recording medium roll so as to respectively protrude to one side and another side in an axial direction and face said support member, and second protruding parts that are disposed on said support member so as to respectively protrude to said one side and said another side in said axial direction and face said recording medium roll.

2. The medium cartridge according to claim 1, wherein said recording medium roll comprises said first protruding parts disposed so as to respectively protrude to said one side and said another side in said axial direction and face said support member.

3. The medium cartridge according to claim 2, wherein said recording medium roll comprises:

a winding core member that includes an outer periphery around which said recording medium is wound;

a flange on one side disposed to said one side from said winding core member in said axial direction; and a flange on another side disposed to said another side from said winding core member in said axial direction;

said first protruding part on one side is disposed on said flange on one side and protrudes to said one side as well as faces said support member, and said first protruding part on another side is disposed on said flange on another side and protrudes to said another side as well as faces said support member.

4. The medium cartridge according to claim 3, wherein said first protruding part on one side is a rib on one side, that has a substantially ring shape and is disposed on said flange on one side having a substantially disk shape; and said first protruding part on another side is a rib on another side, that has a substantially ring shape and is disposed on said flange on another side having a substantially disk shape.

5. The medium cartridge according to claim 4, further comprising a sliding member disposed across said flange on one side and said flange on another side so as to be slidable with respect to said flange on one side and said flange on another side during rotation of said recording medium roll.

6. The medium cartridge according to claim 5, wherein said sliding member is a clip having a substantially U-shape;

said clip comprises:

a bottom wall part that is a bottom section of said U-shape;

left-side wall part and right-side wall part that are side sections of both left and right sides of said U-shape;

a left engaging wall part configured to be engaged with said rib of said flange on one side; and a right engaging wall part configured to be engaged with said rib of said flange on another side.

7. The medium cartridge according to claim 2, further comprising:

third protruding parts disposed so as to protrude along a radial direction of said recording medium roll and face a radial-direction outer-edge of said recording medium roll in said axial direction.

8. The medium cartridge according to claim 7, further comprising a connecting part that is disposed on said support member and connects a bracket on one side and a bracket on another side, wherein the bracket on one side rotatably supports said one side of said recording medium roll in said axial direction and the bracket on another side rotatably supports said another side of said recording medium roll in said axial direction, wherein one of said third protruding parts on one side and the other of said third protruding parts on another side are disposed on said connecting part, wherein the third protruding part on one side is disposed on said one side and comes close to said one side of said radial-direction outer-edge of said recording medium roll, and the third protruding part on another side is disposed on said other side and comes close to said another side of said radial-direction outer-edge of said recording medium roll.

9. The medium cartridge according to claim 8, wherein said third protruding part on one side protrudes between said bracket on one side and a rib on said one side;

said third protruding part on another side protrudes between said bracket on another side and a rib on said another side; and an amount of protrusion of each third protruding part is greater than a distance from said connecting part to each rib.

10. The medium cartridge according to claim 1, wherein said support member comprises said second protruding part on one side disposed so as to protrude to said another side in said axial direction and face said recording medium roll, and said second protruding part on another side disposed so as to protrude to said one side in said axial direction and face said recording medium roll.

11. The medium cartridge according to claim 10, wherein said recording medium roll comprises:

a winding core member that includes an outer periphery around which said recording medium is wound;

a flange on one side disposed to said one side from said winding core member in said axial direction; and a flange on another side disposed to said another side from said winding core member in said axial direction;

said flange on one side and said flange on another side each comprises:

a first area where a through hole having a substantially fan shape is disposed at an equal interval in a circumferential direction; and a second area that has a substantially flat plate shape and is positioned at outside than said first area in a radial direction;

said second protruding part on one side protrudes toward said second area of said flange on one side; and said second protruding part on another side protrudes toward said second area of said flange on another side.

12. The medium cartridge according to claim 10, wherein said support member comprises two brackets that respectively rotatably support said one side and said another side of said recording medium roll in said axial direction;

said second protruding part disposed on said bracket on said one side protrudes to said another side as well as faces said one side of said recording medium roll; and said second protruding part disposed on said bracket on said another side protrudes to said one side as well as faces said another side of said recording medium roll.

13. The medium cartridge according to claim 10, further comprising:

third protruding parts disposed so as to protrude along a radial direction of said recording medium roll and face a radial-direction outer-edge of said recording medium roll in said axial direction.

14. The medium cartridge according to claim 13, further comprising a connecting part that is disposed on said support member and connects two brackets that respectively rotatably support said one side and said other side of said recording medium roll in said axial direction, wherein one of said third protruding parts that is disposed on said one side and comes close to said one side of said radial-direction outer-edge of said recording medium roll is disposed on said connecting part as well as the other of said third protruding parts that is disposed on said another side and comes close to said another side of said radial-direction outer-edge of said recording medium roll is also disposed on said connecting part.

15. The medium cartridge according to claim 1, wherein said recording medium roll comprises said first protruding parts disposed so as to respectively protrude to said one side and said another side in said axial direction and face said support member; and said support member comprises said second protruding parts disposed so as to respectively protrude to said one side and said another side in said axial direction and face said recording medium roll.

16. The medium cartridge according to claim 15, wherein a position where said first protruding part is disposed and a position where said second protruding part is disposed are offset with each other in a radial direction of said recording medium roll so as to not face each other in said axial direction.

17. A printer comprising:

a storage part configured to store a medium cartridge comprising a recording medium roll with a long recording medium wound around an axis, a support member that rotatably supports said recording medium roll, and at least one of first protruding parts that are disposed on said recording medium roll so as to respectively protrude to one side and another side in an axial direction and face said support member, and second protruding parts that are disposed on said support member so as to respectively protrude to said one side and said another side in said axial direction and face said recording medium roll;

a feeder configured to feed said recording medium fed out from said recording medium roll of said medium cartridge;

a printing head configured to perform printing on said recording medium fed by said feeder and generate a recorded medium;

a cutter configured to cut said recorded medium in a predetermined length, the recorded medium generated by said printing head; and a take-up device configured to sequentially wind said recorded medium having said predetermined length after cutting by said cutter on an outer peripheral part of the take-up device, and to form a recorded medium roll.

* * * * *